US006512337B2

(12) United States Patent
Hirano et al.

(10) Patent No.: US 6,512,337 B2
(45) Date of Patent: Jan. 28, 2003

(54) ALTERNATING CURRENT PLANE DISCHARGE TYPE PLASMA DISPLAY PANEL

(75) Inventors: Naoto Hirano, Tokyo (JP); Hiroshi Hasegawa, Tokyo (JP); Nobumitsu Aibara, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/939,755

(22) Filed: Aug. 28, 2001

(65) Prior Publication Data

US 2002/0047591 A1 Apr. 25, 2002

(30) Foreign Application Priority Data

| | | |
|---|---|---|
| Aug. 29, 2000 | (JP) | 2000-259965 |
| Feb. 21, 2001 | (JP) | 2001-045593 |
| Apr. 16, 2001 | (JP) | 2001-117054 |

(51) Int. Cl.[7] ..... G09G 3/10

(52) U.S. Cl. ..... 315/169.4; 315/169.1; 345/55; 345/60; 345/63; 313/494; 313/498

(58) Field of Search ..... 315/169.4, 169.1; 345/55, 60, 63, 66, 67; 313/494, 498, 499

(56) References Cited

U.S. PATENT DOCUMENTS 5,877,734 A * 3/1999 Amemiya ..... 345/60

FOREIGN PATENT DOCUMENTS

| | | |
|---|---|---|
| JP | 08-22772 | 1/1996 |
| JP | 2000-156167 | 6/2000 |

* cited by examiner

*Primary Examiner*—Don Wong
*Assistant Examiner*—Tuyet T. Vo
(74) *Attorney, Agent, or Firm*—Sughrue Mion, PLLC

(57) ABSTRACT

Each cell of a PDP is provided with a pair of narrow and substantially U-shaped plane electrodes, which are connected to a corresponding trace electrode at the open ends thereof (located at the respective non-discharging gap sides) to operate as scan electrode and common electrode. A plane discharging gap is defined between the closed front ends of the plane electrodes. The plane electrodes have a curved profile at the front ends thereof with the highest point located at the longitudinal central axis of the cell. With this arrangement, the effective length of the plane electrodes can be increased without increasing the surface area of the plane electrodes so that the plane electrodes overlap the data electrode at the front ends thereof over an expanded area.

23 Claims, 21 Drawing Sheets

FIG. 5 (PRIOR ART)

| STRUCTURE | LUMINANCE | EFFICIENCY | LOAD | TRANS-MISSION | INTER-FERENCE |
|---|---|---|---|---|---|
| | ○ | × | × | △ | × |
| | × | ○ | △ | ○ | ○ |
| | ○ | ○ | ○ | × | × |

ALTERNATING CURRENT PLANE DISCHARGE TYPE PLASMA DISPLAY PANEL

BACKGROUND OF THE INVENTION

1. Field of the Invention

The present invention relates to an alternating current plane discharge type plasma display panel and, more particularly, it relates to an alternating current plane discharge type plasma display panel having structurally improved plane electrodes.

2. Description of the Related Art

Plasma display panels (to be referred to as PDPs hereinafter) are known and designed to display images by causing electrons accelerated by an electric field to collide with and excite discharge gas and transforming ultraviolet rays emitted by way of a relaxation process into rays of visible light. Such PDPs are normally provided as flat surface image display devices having a large display screen and a large capacity. Particularly, alternating current (to be referred to as AC hereinafter) discharge type PDPs are advantageous in comparison with direct current (to be referred to as DC hereinafter) discharge type PDPs in terms of luminance of emitted light, efficiency of light emission and service life.

Japanese Patent Laid-Open Publication No. Hei. 8-22772 discloses an AC plane discharge type PDP of the type under consideration. FIG. 1 of the accompanying drawings is a partly cut out schematic perspective view of a PDP similar to the one illustrated in FIG. 1 of the above cited publication. FIG. 2A is a schematic plan view of plane electrodes of the PDP similar to those illustrated in FIG. 2 of the above cited publication. FIG. 2B is a schematic cross sectional view of one of the plane electrodes. FIG. 3A is a schematic plan view of plane electrodes similar to those illustrated in FIG. 8 of the above cited publication. FIG. 3B is a schematic cross sectional view of one of the plane electrodes. FIG. 4A is a schematic plan view of plane electrodes similar to those illustrated in FIG. 11 of the above cited publication. FIG. 4B is a schematic cross sectional view of one of the plane electrodes. The structure of the known PDP will be described below with reference to these drawings.

As far as this specification is concerned, a "vertical direction" and a "horizontal direction" correspond to the column direction and the row direction respectively of the plane electrodes of the plasma display device that is typically fitted to a wall surface for use, respectively. The expressions of "longitudinal direction" and "transversal direction" may sometimes be used in place of "vertical direction" and "horizontal direction", respectively, in the following description. The expressions of "upward" and "downward" refer to those directions viewed along the thickness of the glass substrate and along the layers thereon, respectively. More specifically, "upward" refers to the direction in which layers are formed sequentially on the glass substrate in the manufacturing process. A common electrode may also be referred to as a sustenance electrode. A line electrode may also be referred to as a bus electrode or trace electrode.

A plurality of data electrodes 2 typically made of silver (Ag) are formed longitudinally (in the column direction) to run along the longitudinal central axes of the cells on a back substrate 1 typically made of soda-lime glass. A white dielectric layer 3 made of PbO (lead oxide), $SiO_2$ (silicon oxide), $B_2O_3$ (boron oxide), $TiO_2$ (titanium oxide) or $ZrO_2$ (zirconium oxide) is arranged on the data electrodes 2. Then, a plurality of partition walls 4*a* typically made of PbO, $SiO_2$, $B_2O_3$, $TiO_2$, $ZrO_2$ or $Al_2O_3$ are formed on the white dielectric layer 3 and run longitudinally in parallel with the data electrodes 2. Fluorescent layers 5 that are adapted to emit visible rays of light of red, green and blue (fluorescent layers 5*a* for red cells, fluorescent layers 5*b* for green cells, fluorescent layers 5*c* for blue cells) are arranged alternately on the white dielectric layer 3 including the lateral surfaces of the partition walls 4*a*.

A plurality of plane electrodes 7*a* typically made of SnO2 (tin oxide) or ITO (indium tin oxide) are formed on the bottom surface of a front substrate 6 typically made of soda-lime glass so that each one crosses the corresponding transversal central axes of the cells. More specifically, plane electrodes 7*a* are arranged in the transversal direction (in rows) and in the longitudinal direction (in columns). Narrow strip-shaped trace electrodes 8*a* typically made of silver (Ag) are formed under the plane electrodes 7*a* and run transversally in a direction perpendicular to the data electrodes 2. The trace electrodes 8*a* are provided in pairs. The plane electrodes 7*a* corresponding to each pair of trace electrodes 8*a* are electrically connected to the latter to form a scan electrode 9*a* and a common electrode 10*a* that run transversally (in the row direction). The resulting scan electrodes group and the common electrodes group are arranged alternately in the longitudinal direction (column direction). A transparent dielectric layer 11 typically made of PbO, SiO2 or B2O3 is formed under the scan electrodes 9*a* and the common electrodes 10*a* and then a protection layer 12 typically made of MgO (magnesium oxide) is formed under the transparent dielectric layer 11.

Then, the back substrate 1 and the front substrate 6 are bonded to each other with the layered structures facing each other and the entire device is air-tightly sealed by means of frit glass arranged along the peripheral edges of the substrates. The device contains therein a discharge gas such as He (helium), Ne (neon), Ar (argon), Kr (krypton) or Xe (xenon) for generating ultraviolet rays to show a predetermined internal pressure level.

A visible light reflecting layer containing $TiO_2$, $ZrO_2$ or the like may be arranged under the fluorescent layer 5 on the back substrate 1 in order to improve the luminance of emitted light. Similarly, colored layers corresponding to the red cells, the green cells and the blue cells may be arranged in the transparent dielectric layer 11 in order to improve the color temperature and the color purity.

Now, the operation of the PDP having the above described configuration will be described below. The data electrodes 2 to which a signal voltage pulse is applied independently on a line by line basis and the scan electrodes 9*a* to which a scan voltage pulse is applied sequentially on a line by line basis are made to electrically discharge oppositely for writing discharges. This is done in order to generate wall charges and priming particles (electrons, ions, meta-stable particles, etc.) and select cells. Then, the scan electrodes 9*a* to which a sustained voltage pulse is applied after the application of the scan voltage pulse and the common electrodes 10*a* are made to give rise to sustaining discharges that are plane discharges. This is done in order to cause the fluorescent layer 5 to emit visible light and make the cells operate for displaying an image.

The known arrangement of electrodes described above and illustrated in FIGS. 2A and 2B is adapted to provide each cell (unitary light emitting pixel) with a plane electrode 7*a* to reduce the surface area of the plane electrodes 7*a* as a whole and also with a sustaining discharge current. The light emitting efficiency of the panel is maximized while the sustained voltage is reduced to by turn lower the power consumption rate by optimizing a length L1 and a width W1 of the plane electrode. As a result, the temperature rise of the panel in operation is suppressed to improve the reliability of operation of the panel.

Referring to FIGS. 3A and 3B, or FIGS. 4A and 4B showing alternative known arrangements of electrodes, the plane electrodes 7*b* and 7*c* are provided with narrow sections 13*a* and 13*b* respectively to further reduce the surface area of the plane electrodes 7*b* and 7*c* as a whole and lower the sustaining discharge current. As a result, the power consumption rate of either arrangement of FIGS. 3A and 3B or FIGS. 4A and 4B is reduced from that of the arrangement of FIGS. 2A and 2B so that the temperature rise of the panel in operation is further suppressed.

Particularly, in the case of the plane electrodes 7*b* shown in FIGS. 3A and 3B and the plane electrodes 7*c* shown in FIGS. 4A and 4B, it is possible to produce preliminary discharge plasma on a stable basis only in limited areas located near the plane discharging gaps when the device is operating for preliminary discharges (plane discharges for reducing the variances in the operating performance among the cells). Thus, it is possible to increase the difference between the intensity of emission of visible light of the preliminary discharge phase and that of the sustaining discharge phase to consequently improve the contrast of the displayed image if compared with the arrangement of the plane electrodes 7*a* without such narrow sections 13*a* and 13*b*.

Meanwhile, Japanese Patent Laid-Open Publication No. 2000-156167 discloses an AC drive plane discharge type plasma display panel including a pair of transparent plane electrodes (including a scan electrode and a common electrode) disposed to face via a discharging gap located between them and provided with a plurality of micro-holes. Additionally, the publication describes that, by providing the transparent plane electrodes with such micro-holes, any possible increase in the current density that can occur when the dielectric layer is made thinner to reduce the operating voltage can be prevented from taking place. This consequently secures a light emitting efficiency and a service life of the AC-PDP. However, the above described prior art is accompanied by the following problems. Firstly, while the known structural arrangement shown in FIGS. 2A and 2B provides a high luminance of emitted light, it entails a low light emitting efficiency and a large operating load as well as a poor performance in terms of transition from writing discharges (selecting operation) to sustaining discharges (display operation) and a large discharge interference.

FIG. 2B is a schematic cross sectional view taken along line A—A in FIG. 2A. Referring to FIG. 2B, the ultraviolet rays 14 generating region that is effectively utilized for transforming UV rays into rays of visible light in the fluorescent layer 5 is an outer region 15*a* of the sustaining discharge plasma (or the region located outside the broken line shown in FIG. 2B). In other words, an inner region 16*a* of the sustaining discharge plasma (or the region located inside the broken line in FIG. 2B) simply wastes power. With the known structural arrangement of FIG. 2B, while sustaining discharge plasma expands to all the cells and hence the luminance of emitted light is raised because the fluorescent layer 5 is irradiated with ultraviolet rays 14 over a wide area, power is lost to a large extent to lower the light emitting efficiency. At the same time an inutile inner region 16*a* that is not effectively used for transforming ultraviolet rays into rays of visible light also expands. A poor light emitting efficiency means a high power consumption rate for the display operation.

For the cell selecting operation and the display operation, the plane electrodes 7*a* do not necessarily need to be uniformly arranged over all the cells. The plane electrodes are required to effectively expand sustaining discharge plasma without adversely affecting the transition from writing discharges to sustaining discharges. Therefore, the plane electrodes need to be designed to meet this requirement in order to maximize the efficiency of operation. However, with the known structural arrangement of FIGS. 2A and 2B where the plane electrodes 7*a* are arranged over all the cells, the plane electrodes 7*a* and the data electrodes 2 show a high degree of inutile capacity coupling. This gives rise to a large operating load for electrically charging the capacities. As the inutile capacity coupling increases, a large amount of power needs to be consumed when charging the capacities and the waveform of the voltage pulse may be deformed to degrade the display performance of the panel.

Additionally, as for the transition from writing discharges to sustaining discharges, it is very important to generate wall charges highly densely near the plane discharging gaps, particularly on the longitudinal central axes of the cells (or on the data electrodes 2) on the plane electrodes. However, with the known structural arrangement of FIGS. 2A and 2B where the plane electrodes 7*a* are formed extensively over the data electrodes 2, writing discharges occur in a scattered manner over a large area. This generates a poor distribution pattern of wall charges that are formed by writing discharges. When wall charges formed by writing discharges show a poor distribution pattern, in addition to the deterioration of the transition to sustaining discharges, cells that are arranged adjacently in the longitudinal and transversal directions can give rise to discharge interferences so that error ONs and error OFFs can occur with the cells. Then, the device is forced to operate only with a narrow margin.

The wall charges that are generated by sustaining discharges do not need to show a uniform distribution pattern over all the cells. However, with the known structural arrangement of FIGS. 2A and 2B where the plane electrodes 7*a* are formed extensively over all the cells, strong sustaining discharges can spread over all the cells so that the wall charges formed by sustaining discharges show a widely spread distribution pattern. Particularly when wall charges are produced densely close to non-discharging gaps, the power consumption rate rises remarkably due to writing discharges, sustaining discharges and preliminary discharges and it becomes no longer possible to cancel the unnecessary wall charges on the plane electrodes 7*a* by preliminary discharges. Then, as pointed out above, cells that are arranged adjacently in the longitudinal and transversal directions can give rise to discharge interferences so that error ONs and error OFFs can occur with the cells. Thus, the device is forced to operate only with a narrow margin.

If the length L1 and the width W1 of the plane electrodes are reduced in an attempt for solving the above problem, new problems including a lowered luminance of emitted light and a high sustained voltage will occur.

While the known structural arrangement of electrodes shown in FIGS. 3A and 3B provides a high light emitting efficiency, a good performance for transition from writing discharges to sustaining discharges and scarce discharge interferences, it is accompanied by the problems of a low luminance of emitted light and a large operation load.

FIG. 3B is a schematic cross sectional view taken along line B—B in FIG. 3A. The luminance of emitted light of the PDP that is observed is that of light produced by the fluorescent layer 5 as a result of transformation from ultraviolet rays into rays of visible light. Therefore, preferably the fluorescent layer 5 is irradiated extensively with ultraviolet rays 14 until the capacity of the fluorescent layer 5 for transforming ultraviolet rays into rays of visible light is saturated for the purpose of achieving a high luminance of emitted light. However, with the known structural arrangement of electrodes shown in FIGS. 3A and 3B, sustaining discharge plasma is contracted to reduce its volume along the narrowed sections 13*a* formed on the longitudinal central axes of the cells (or on the data electrodes 2). As the volume of sustaining discharge plasma is reduced, the rate of generation of the ultraviolet rays 14 is also reduced to make it no longer possible to irradiate extensively the fluorescent layer 5 with ultraviolet rays 14. Then, the luminance of emitted light is reduced because the rate at which ultraviolet rays are transformed into rays of visible light is lowered.

Furthermore, referring to FIG. 3B, as the distance separating the outer region 15*b* of the sustaining discharge plasma and the fluorescent layer 5 is increased, of the ultraviolet rays including those (resonance beams: wavelength of 147 nm) emitted from excited Xe atoms and those (molecular beams: wavelength of 172 nm) emitted from excited Xe molecules, which are typical sources of ultraviolet rays 14, only resonance beams are utilized with a poor efficiency to by turn reduce the rate at which the fluorescent layer 5 transforms ultraviolet rays into rays of visible light. The reason for this is that, since resonance beams reach the fluorescent layer 5 and repeat the process of resonance absorption/relaxation radiation with Xe atoms in a ground state, there is high probability that the sustaining discharge plasma will lose energy for irradiating ultraviolet rays 14 on the way. This is due to the effect of ionization due to collisions of electrons and ions when the outer region 15*b* of the sustaining discharge plasma and the fluorescent layer 5 are separated from each other by a long distance. It should be noted that the light emitting efficiency of the known electrode arrangement of FIGS. 3A and 3B is higher than that of the known electrode arrangement of FIGS. 2A and 2B because the inner region 16*b* of sustaining discharge plasma that wastes power is smaller in the former.

Still additionally, with the known structural arrangement of electrodes shown in FIGS. 3A and 3B, the plane electrodes 7*b* are formed only near the plane discharging gaps and on the longitudinal central axes of the cells (or on the data electrodes 2). With such an arrangement, while the wall charges formed by writing discharges and sustaining discharges show a good distribution pattern and the transition from writing discharges to sustaining discharges operate well to reduce discharge interferences, a large inutile capacity coupling remains between the plane electrodes 7*b* and the data electrodes 2. This makes an operating load for electrically charging the capacities larger. As pointed out earlier, when the inutile capacity coupling is large, a large amount of power needs to be consumed when charging the capacities and the waveform of the voltage pulse may be deformed to degrade the display performance of the panel. If the width W2 of the plane electrodes is reduced in an attempt for solving the above problem, new problems including a lowered luminance of emitted light and a rise in both the writing voltage and the sustained voltage will occur. If the length L2 of the plane electrodes is increased, a reduction in the contrast of the displayed image will occur and the distribution of the wall charges will deteriorate.

Now, while the known structural arrangement of electrodes shown in FIGS. 4A and 4B provides a high luminance of emitted light, a high light emitting efficiency and a low operation load, it is accompanied by the problems of a poor performance for transition from writing discharges to sustaining discharges and frequent discharge interferences.

FIG. 4B is a schematic cross sectional view taken along line C—C in FIG. 4A. With the known structural arrangement of electrodes shown in FIGS. 4A and 4B, sustaining discharge plasma can easily expand over all the cells along the narrow sections 13*b* arranged at the opposite sides of the longitudinal central axes of the cells (or the data electrodes 2). Since the narrow sections 13*b* are formed along the lateral surfaces of the partition walls 4, the positional relationship between the outer region 15*c* of sustaining discharge plasma and the fluorescent layer 5 is improved if compared with that of the known structural arrangement of FIGS. 3A and 3B. Therefore, ultraviolet rays 14 can be effectively irradiated to a large area of the fluorescent layer 5 to improve the luminance of emitted light and the light emitting efficiency. Additionally, the operation load for electrically charging the capacities is reduced because the capacity coupling between the plane electrodes 7*c* and the data electrodes 2 is small.

However, with the known structural arrangement of FIGS. 4A and 4B, the plane electrodes 7*c* and the data electrodes 2 overlap each other only in a very small area to consequently reduce the statistic dielectric breakdown paths (dielectric breakdown probability) between them. The net result will be a raised writing voltage and a lowered writing rate. Additionally, the wall charges generated by writing discharges become insufficient to degrade the performance of transition from writing discharges to sustaining discharges. While the performance of transition from writing discharges to sustaining discharges may be improved by raising the writing voltage and/or the sustained voltage, such a measure by turn raises the operating voltage to increase the power consumption rate and the load on the part of the drive circuit. Additionally, error ONs and error OFFs can occur with unselected cells to degrade the quality of the displayed image.

With the known structural arrangement of FIGS. 4A and 4B, the gap between the plane electrodes 7*c* of transversally adjacent cells is small and hence those cells can give rise to error ONs and error OFFs due to discharge interferences. Thus, the device is forced to operate only with a narrow margin.

If the length L3 of the plane electrodes is increased in an attempt for solving the above problem, new problems including an increase in the inutile capacity coupling, the power consumption rate and the operating load and a reduction in the contrast of the displayed image will occur. If, on the other and, the width W3 of the plane electrodes is reduced, the luminance of emitted light will be reduced.

FIG. 5 is a chart where the performances of the above cited known structural arrangements are rated for comparison. It will be appreciated that each of them has its own advantages and disadvantages and hence is not adapted to solve all the above-identified problems.

The plane electrodes of a PDP disclosed in Japanese Patent Laid-Open Publication No. 2000-156167 are provided with numerous micro-holes formed through them and the effective area of the plane electrodes is reduced by controlling the diameter of the micro-holes and the thickness of the dielectric layer to reduce the discharge current that flows at a rate proportional to the effective area of the plane electrodes in an attempt for solving a problem. The problem is that, when the thickness of the dielectric layer is reduced to lower the discharge start voltage, the discharge current flowing through the plane electrodes increases in a manner as defined by formulas of [electric charge Q=capacity C×voltage V] and [capacity C=relative dielectric constant ϵ×area S/distance d]. In other words, the discharge current that flows at a rate proportional to the effective area of the plane electrodes is reduced by reducing the effective area of the plane electrodes for releasing electric charges (the area of the plane electrodes except the holes) without changing the area of the plane electrodes (as defined by the outer peripheral edges) that affects the discharge spaces and defines the discharge regions.

However, while the known technology disclosed in the above cited publication may be effective for reducing the discharge current, it does not go any further and hence is insufficient for highly efficiently generating plasma in the discharge spaces and thoroughly expanding the generated plasma.

SUMMARY OF THE INVENTION

It is an object of the present invention to provide an AC plane discharge type plasma display panel that operates reliably for electric discharges with a low power consumption rate and is adapted to satisfactorily expand plasma in the discharge spaces and display high quality images.

An alternating current plane discharge type plasma display panel according to the present invention comprises a front substrate having a plurality of pairs of scan electrodes and common electrodes arranged in a horizontal direction, and a back substrate disposed to face said plane electrodes and having a plurality of vertically extending data electrodes. The scan electrodes and said common electrodes comprise horizontally extending line electrodes and plane electrodes provided for corresponding unit light emitting pixels. The plane electrodes of said scan electrode and said common electrode in each unit light emitting pixel are separated from each other by a discharging gap. Each of said plane electrodes has a first section located close to said discharging gap and a second section located remotely from said discharging gap. The first section has a part overlapping said data electrode as viewed from above and parts extending horizontally from a part overlapping said data electrode. The second section has lateral parts extending vertically along lateral edges of said corresponding data electrode as viewed from above. Partition walls are arranged between said front substrate and said back substrate to form discharge spaces. The partition walls define unit light emitting pixels of red, green and blue. Discharge gas is introduced in said discharge spaces to generate ultraviolet rays.

Thus according to the invention, the profile and the arrangement of the plane electrodes are selected so as to optimize the mode of producing electric discharges and that of expanding plasma in the cells (discharge spaces). Additionally, the positions of the plane electrodes (discharge sections) in the corresponding discharge spaces are selected so as to realize a good balance for the luminance, the light emitting efficiency and the driving characteristics. By appropriately defining the profile and the arrangement of the plane electrodes, discharges can be generated without waste and plasma can be made to expand thoroughly in the discharge spaces for effective emissions of light.

In the AC plane discharge type plasma display panel according to the invention, the first section located close to the discharging gap and the second section located remotely from the discharging gap of each of the plane electrodes may independently have edges that are curved or intersecting each other with an obtuse angle at comers thereof.

Each of the plane electrodes may be connected to the corresponding line electrode at the end part of the second section located opposite to the discharging gap.

The second section of each of the plane electrodes may have (1) a part projecting or extending vertically above the corresponding data electrode from the first section, (2) parts extending in opposite directions from the lateral parts, (3) additionally the extending parts being connected to each other, (4) an inclined part extending in a direction inclined relative to the vertical direction and connecting the lateral parts and a horizontal central part of the first section, (5) an inclined part extending in a direction inclined relative to the vertical direction and connecting the lateral parts and horizontally opposite ends of said first section, (6) a part connecting ends thereof located remotely from the discharging gap, and (7) an inclined part extending in a direction inclined relative to the vertical direction from the lateral parts to the line electrodes so as to come closer. The inclined parts in the case (7) above may be tapered toward the line electrode. Additionally, the inclined parts in the case (7) may be connected to the line electrode at a position overlapping corresponding edges of the date electrode as viewed from above or at a position located at the transversal center of the data electrode.

The line electrodes may be made of a metal material and the plane electrodes may be made of a metal material or a transparent material.

Additionally, a distance between plane electrodes forming said discharging gap may be made to vary continuously or discontinuously in the transversal direction of the plane electrodes.

Both or either of the profile or the area of the first section and that of the second section may be differentiated between the scan electrode and the common electrode.

In the unit light emitting pixels of red, those of green or those of blue, or in one or more unit light emitting pixels, both or either of the profile or the area of the first section and that of the second section may be differentiated between the scan electrode and the common electrode.

In each of the unit light emitting pixels, each of the plane electrodes may be made to overlap the corresponding data electrode at least at two positions along the edges of the plane electrode that are the outer edges of a pattern thereof.

The plasma display panel may further comprise an electrically conductive material connecting at least either said scan electrodes or said common electrodes between the horizontally adjacent unit light emitting pixels. The electrically conductive material may be same as or different from the material of the plane electrodes.

As described above, with the PDP according to the present invention, it is possible to increase the wall charge at the front end of each plane electrode so that the performance of transition from writing discharges to sustaining discharges can be improved to realize a quick transition than ever. As a result, the device can operate with a wide margin to improve the quality of the displayed image.

Additionally, with the PDP according to the present invention, both the convergence of preliminary discharge plasma at the front end of each plane electrode and that of sustaining discharge plasma directed from the plane discharging gap toward the non-discharging gap can be raised to reduce the discharge interferences between adjacent cells than ever. As a result, the device can operate with a wide margin to improve the quality of the displayed image. Additionally, the contrast of the displayed image can be improved.

With the PDP according to the present invention, the degradation of the protection layer and the growth of the electrically conductive light shielding deposit due to local impacts of ions can be alleviated to reduce fluctuations in the operating voltage and the luminance of emitted light than ever. As a result, the panel can enjoy a prolonged service life than ever.

With the PDP according to the present invention, the characteristics of each of the components of the plane electrodes can be controlled by regulating the performance thereof without adversely affecting the luminance of emitted light and the light emitting efficiency. Therefore, any difference in the operating voltage among the cells can be reduced than ever to improve the color temperature and the color purity. As a result, the quality of the displayed image can be improved than ever.

Furthermore, with the PDP according to the present invention, the plane discharging gap is broadened continuously or discontinuously so that the discharges in the narrow gap areas can trigger discharges in the wide gap areas to improve the luminance of emitted light and the light emitting efficiency due to the positive column effect. As a result, the power consumption rate of the panel can be reduced to reduce the degradation of the reliability of the device due to emission of heat.

Moreover, with the PDP according to the present invention, electric discharges can easily take place due to the trigger effect of the edges of the plane electrodes so that writing discharges can be generated quickly with a low voltage than ever. As a result, the panel can operate with a wide margin to improve the quality of the displayed image.

Additionally, with the PDP according to the present invention, the plane electrodes may be made of a metal material instead of a transparent conductive material, which is normally used for conventional plane electrodes, so that the manufacturing yield can be improved at reduced manufacturing cost. As a result, it is possible to provide PDPs at low cost then ever.

Furthermore, with the PDP according to the present invention, the plane electrodes can be electrically connected by means of other than line electrodes (for example, an electrically conductive material same as that of the plane electrodes) to minimize risk of producing broken wires for the electrodes as well as structural defects. As a result, the yield of manufacturing panels can be improved than ever.

BRIEF DESCRIPTION OF THE DRAWINGS

FIG. 5 is a chart rating the performances of the prior art structural arrangements;

DETAILED DESCRIPTION OF THE PREFERRED EMBODIMENT

Figure 6:
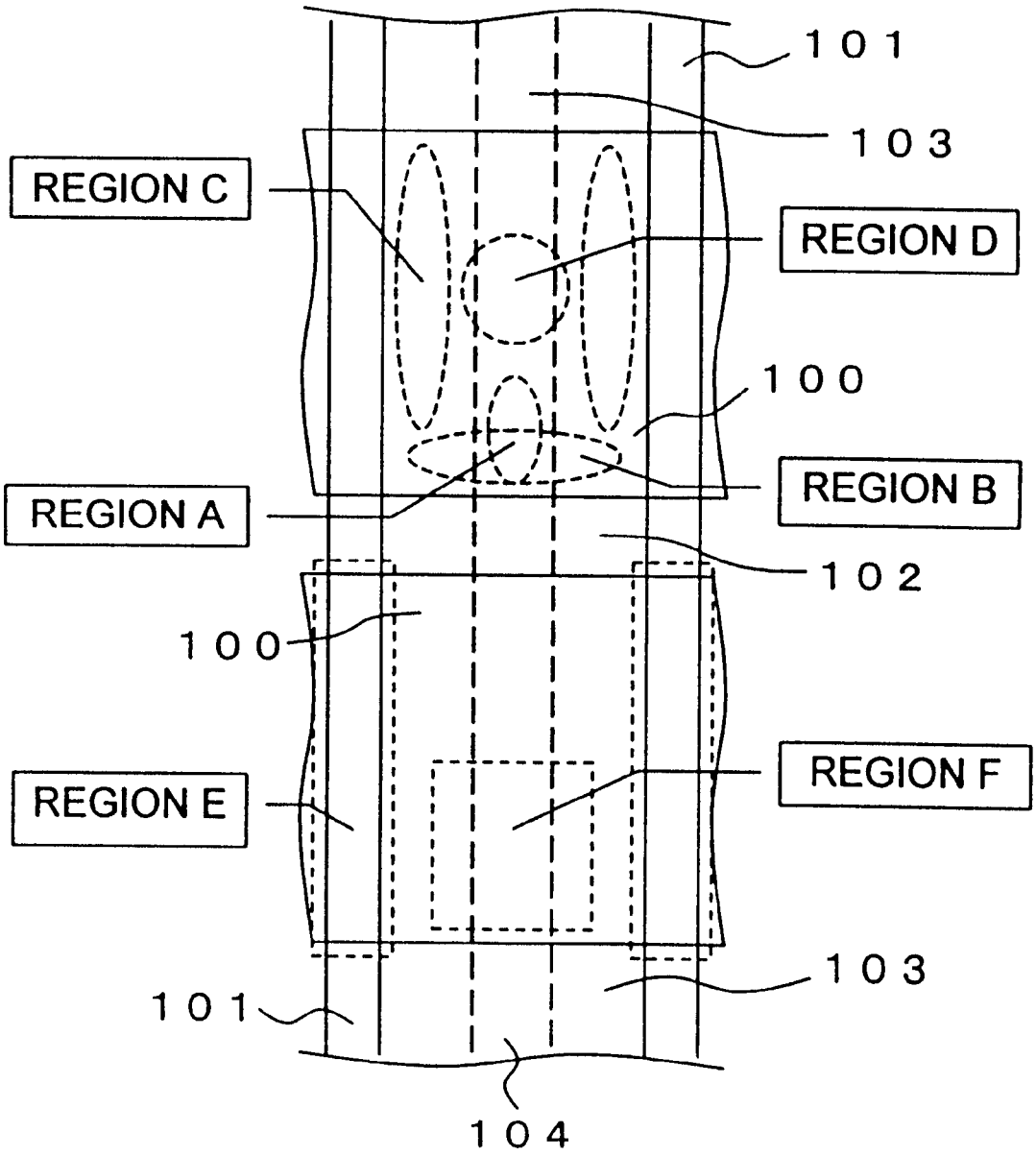
FIG. 6 is a plan view of the spatial role of plane electrodes.

Now, the present invention will be described in greater detail by referring to the accompanying drawings that illustrate preferred embodiments of the invention. FIG. 6 is a schematic illustration of the spatial role of plane electrodes. Referring to FIG. 6, a cell is formed between a pair of longitudinally extending partition walls 101 and a pair of longitudinally (in the column direction) adjacently arranged plane electrodes 100 (a scan electrode and a common electrode) are separated from each other by a plane discharging gap 102. The opposite ends of the plane electrodes 100 located remotely from the plane discharging gap 102 face respective non-discharging gaps 103. A strip-shaped data electrode 104 extends longitudinally (in the column direction) between the partition walls 101.

Of the discharge space defined by the plane electrodes 100 and the partition walls 101, region A is required to produce writing discharges. Preferably, the region A is so arranged that wall charges are densely distributed on the longitudinal central axis (the data electrode) of the cell near the plane discharging gap, while a certain overlapping area is secured for the plane electrodes and the data electrode.

Region B is required to produce sustaining discharges. Preferably, the region B is so arranged that wall charges are densely distributed along the plane discharging gap, while the plane electrodes are secured to extend over a certain area.

Region C is required to effectively expand sustaining discharge plasma in the entire cell. Preferably, the region C is so arranged that wall charges are not distributed too extensively, while the plane electrodes and the data electrode are restricted from overlapping each other excessively.

Region D is required to improve the potential distribution in the entire cell and encourage sustaining discharge plasma to expand in the entire cell. Preferably, the region D is so arranged that wall charges are not distributed too extensively, while the plane electrodes and the data electrode are restricted from overlapping each other excessively.

Region E represents areas where power can be wasted significantly due to the excessive charging of the dielectric layer and the re-coupling of electric charges along the lateral surfaces of the partition walls. Preferably, the area of the plane electrodes is reduced for the region E in order to suppress discharge interferences with transversally adjacently located cells.

Region F represents an area that does not strongly affect the transition from writing discharges to sustaining discharges. Preferably, the area of the plane electrodes is reduced for the region F in order to suppress any increase in the power consumption due to wasteful discharges and discharge interferences with longitudinally adjacently located cells.

The present invention is based on the above described idea. Now, the present invention will be described further by way of embodiments.

Embodiment 1

Figure 7:
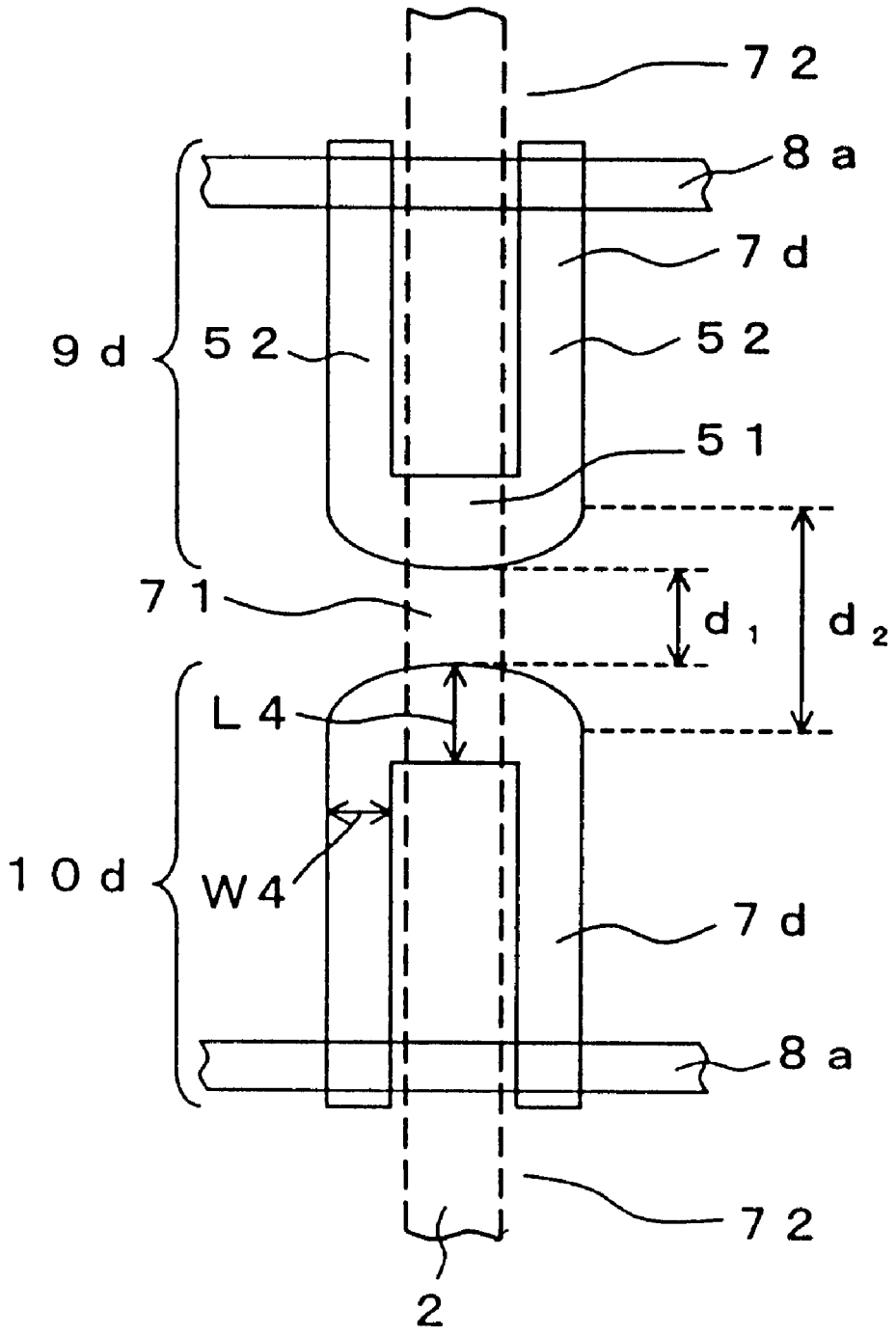
FIG. 7 is a plan view of plane electrodes of a plasma display panel according to a first embodiment of the present invention, illustrating the structural arrangement thereof.

FIG. 7 is a plan view of a pair of plane electrodes of a PDP according to a first embodiment of the present invention, illustrating the structural arrangement thereof. The present embodiment differs from the prior art PDP shown in FIG. 1 in terms of the profile of the plane electrodes. Otherwise, the embodiment is in principal the same as the prior art PDP shown in FIG. 1. As shown in FIG. 7, a pair of narrow and substantially U-shaped transparent plane electrodes 7*d* are arranged in each cell. The plane electrodes 7*d* are connected to respective trace electrodes 8*a* at the open ends (near non-discharging gaps 72) thereof and operate respectively as scan electrode 9*d* and common electrode 10*d*. The front ends or the closed ends (near plane discharging gap 71) of the plane electrodes 7*d* define the plane discharging gap 71 between them. The scan electrode 9*d* and the common electrode 10*d* constituting the single cell are arranged between a pair of partition walls (not shown in FIG. 7), which are extending longitudinally (in the column direction). A data electrode 2 extends longitudinally at the center between the partition walls as viewed from above.

Thus, the scan electrode 9*d* and the common electrode 10*d* of this embodiment are disposed to face each other with the plane discharging gap 71 located between them. They are axially symmetric relative to the center line of the plane discharging gap 71. Each of the pair of plane electrodes 7*d*, including the scan electrode 9*d* and the common electrode 10*d*, has a first section 51 located close to the plane discharging gap 71 and a second section 52 located close to the non-discharging gap 72. When viewed from above, the first section 51 has a part overlapping the data electrode 2 and parts extending transversally (in the row direction) from that part. On the other hand, the second section 52, which is located close to the non-discharging gap, has two lateral parts extending longitudinally (in the column direction) along the opposite lateral sides of the data electrode 2. While the second section 52 of this embodiment does not overlap the data electrode 2 as viewed from above, the second section 52 may alternatively partly overlap the data electrode 2. The lateral parts of the second section 52 are connected at the ends that are located close to the non-discharging gap to the respective trace electrodes 8*a*.

Figure 8:
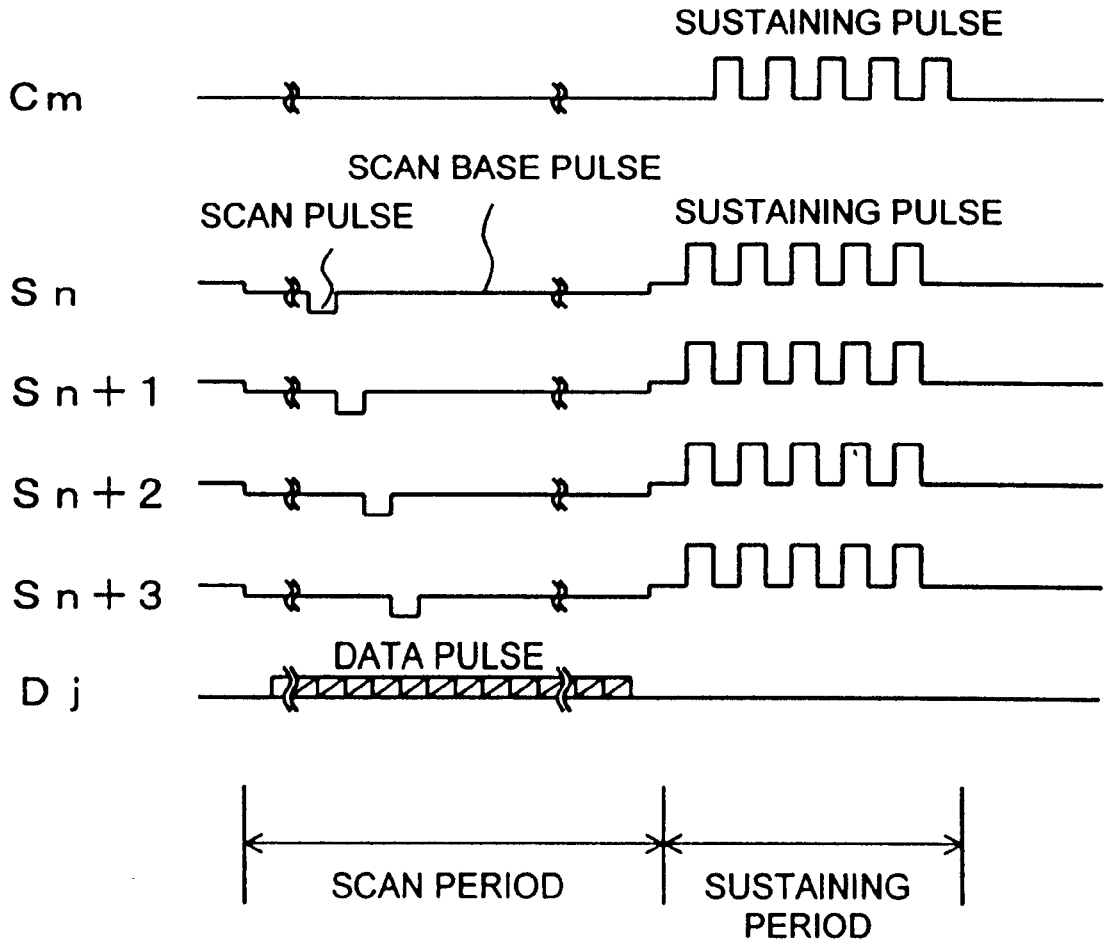
FIG. 8 is a timing chart illustrating a method for driving the PDP according to the first embodiment.

The PDP according to the first embodiment of the present invention can be driven to operate in a manner as described above by referring to the prior art PDP of FIG. 1. FIG. 8 is a timing chart showing one example of the method for driving the first embodiment of PDP. In this embodiment, fluorescent layers for a red cell, a green cell and a blue cell are arranged sequentially and cyclically in the discharge spaces defined by partition walls on each data electrode. In other words, light emitting cells of red, green and blue are arranged sequentially and cyclically in the transversal direction (row direction). The plurality of scan electrodes 9*d* of each row arranged in the row direction are commonly connected to a trace electrode 8*a* extending also in the row direction. The plurality of common electrodes 10*d* of each row arranged in the row direction are commonly connected to adjacently located another trace electrode 8*a*.

FIG. 8 is a timing chart illustrating the waveforms of the driving signals applied to the respective electrodes. In FIG. 8, Sn represents the scan electrode of the n-th row and Cm represents the common electrodes.

A scan pulse is applied sequentially to the scan electrodes Sn, Sn+1, Sn+2, Sn+3, . . . . At the timing of each scan pulse, a data pulse showing the polarity opposite to that of the scan pulse and representing the display data to be displayed by the display cell on the scan electrode is applied to the data electrode Dj. As a result, opposite discharges are produced between the scan electrodes Sn, . . . and the data electrode Dj. Positive wall charges are generated on the surfaces of the scan electrodes Sn, . . . by the writing operation caused by the opposite discharges. Subsequently, in a display cell where wall charge is generated, plane discharges are generated by the sustained pulse applied between the common electrode Cm and the scan electrodes Sn, . . . .

On the other hand, in a display cell where no wall charge is generated and no writing operation takes place because no data pulse is applied and hence no discharge occurs between the data electrode and the scan electrode, there does not arise any overlapping effect of electric fields due to wall charges so that no sustaining discharge occurs if a common pulse is applied.

Light emitting display is carried out as a sustained pulse is applied for a predetermined number of times to each of the display cells where wall charges are generated.

It is not necessary to apply a pulse such as a scan pulse that is selected for each electrode to the common electrodes Cm. Therefore, the common electrodes Cm are commonly connected and hence the same voltage waveform is applied to them as shown in FIG. 8. In the case of commercially available PDPs, a preliminary discharge operation is normally conducted before the start of a writing operation in order to improve the writing performance. In the preliminary discharge operation, a high voltage is applied to all the cells of the PDP to forcibly realize discharges. The inside of the cells will be activated and appropriate wall charges will be generated by this preliminary discharge operation.

With the structural arrangement of electrodes of this embodiment shown in FIG. 7, the outer edge of the front end of each plane electrode 7*d*, which is located close to the discharging gap (the first part 51) is curved and the highest point is found on the longitudinal central axis. The corners of that end are rounded. With this arrangement, the length L4 of the plane electrode can be increased to increase the area where the front end of the plane electrode 7*d*, which is located close to the discharging gap, overlaps the data electrode 2 without increasing the overall area of the plane electrode 7*d*. Therefore, the rise of the writing voltage and the fall of the writing rate can be suppressed. Additionally, the wall charges generated by writing discharges can be increased so that the device can operate with a wide margin then ever. Still additionally, the discharging gap shows a length that gradually increases in the transversal direction from the longitudinal central axis of the cell, where the length is $d_1$, to the outer edges of the plane electrode, where the length is $d_2$ ($d_1<d_2$). Thus, the front end of the plane electrode (the transversal central part of the first section 51) overlaps the data electrode 2 over a large area at the maximum so that the amount of wall charges is maximized there. As a result, the distribution of the wall charges on the plane electrode 7*d* can be improved than ever to improve the performance of transition from writing discharges to sustaining discharges.

Additionally, with the structural arrangement of electrodes of this embodiment shown in FIG. 7, the length of the discharging gap is minimized on the longitudinal central axis of the cell, where the length is $d_1$. This means that the probability of sustaining discharges can be maximized on the longitudinal central axis of the cell. Then, since the preliminary discharges and the sustaining discharges are highly converged at the front end of the plane electrode, it is now possible to prevent the strong discharges in the preliminary phase and also in the initial stages of the sustaining discharge phase from significantly affecting longitudinal and transversal adjacent cells. As a result, the contrast of the displayed image can be improved and discharge interferences can be alleviated.

Figure 2A:
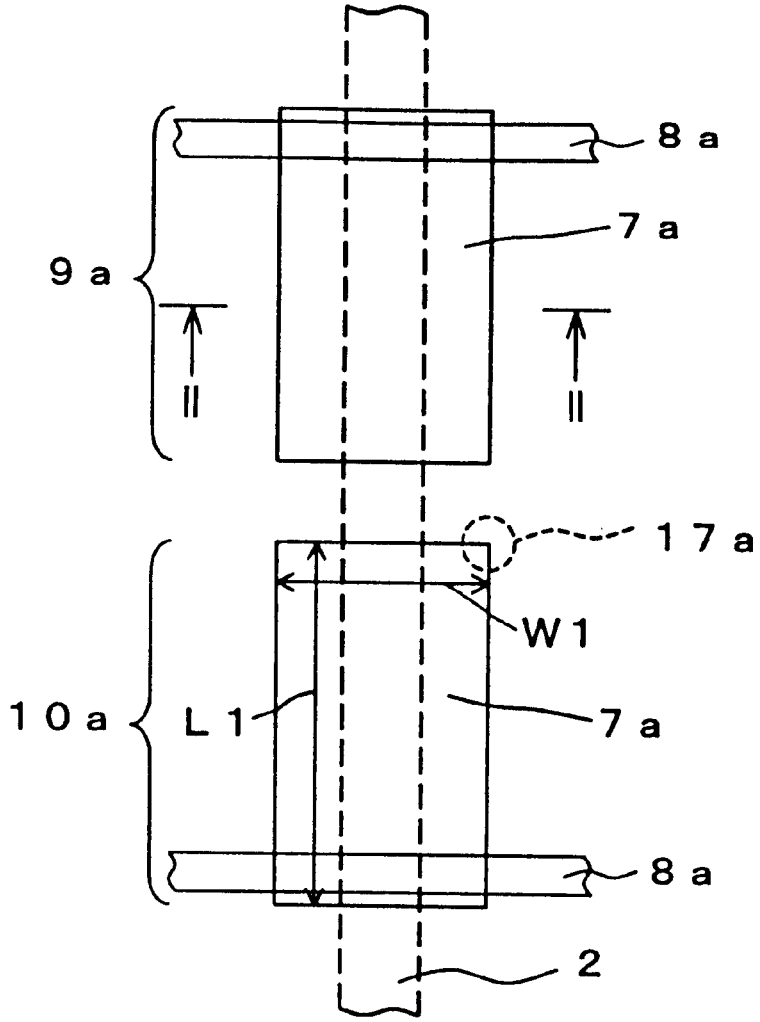
FIG. 2A (PRIOR ART)
FIG. 2A is a plan view of prior art plane electrodes, illustrating the structural arrangement thereof.
Figure 2B:
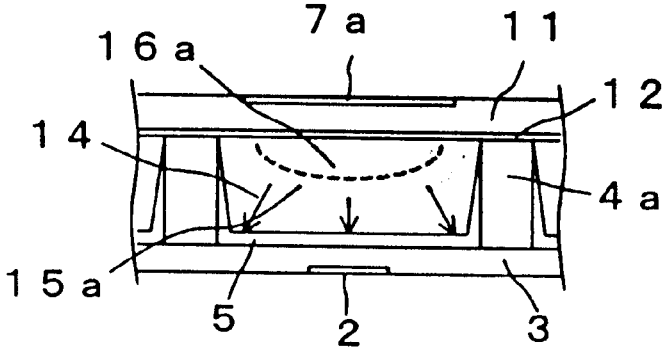
FIG. 2B (PRIOR ART)
FIG. 2B is a cross sectional view taken along line A—A in FIG. 2A.
Figure 3A:
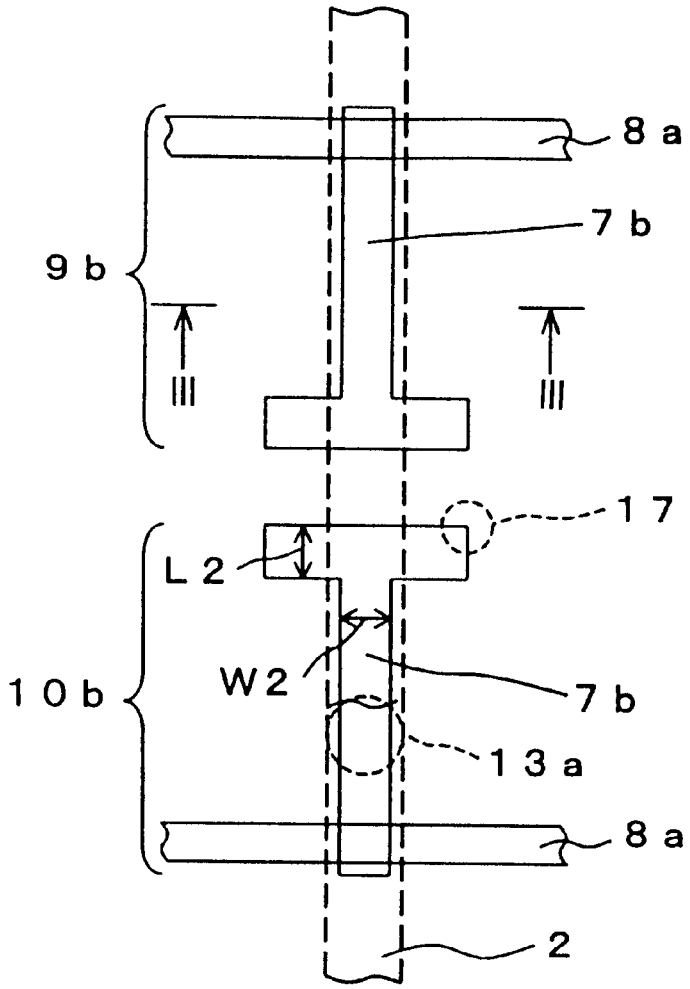
FIG. 3A (PRIOR ART)
FIG. 3A is a plan view of other prior art plane electrodes, illustrating the structural arrangement thereof.
Figure 3B:
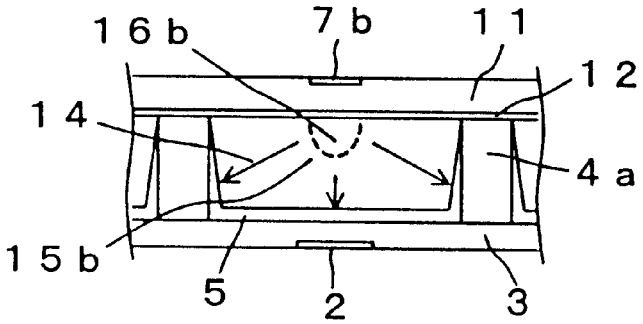
FIG. 3B (PRIOR ART)
FIG. 3B is a cross sectional view taken along line B—B in FIG. 3A.
Figure 4A:
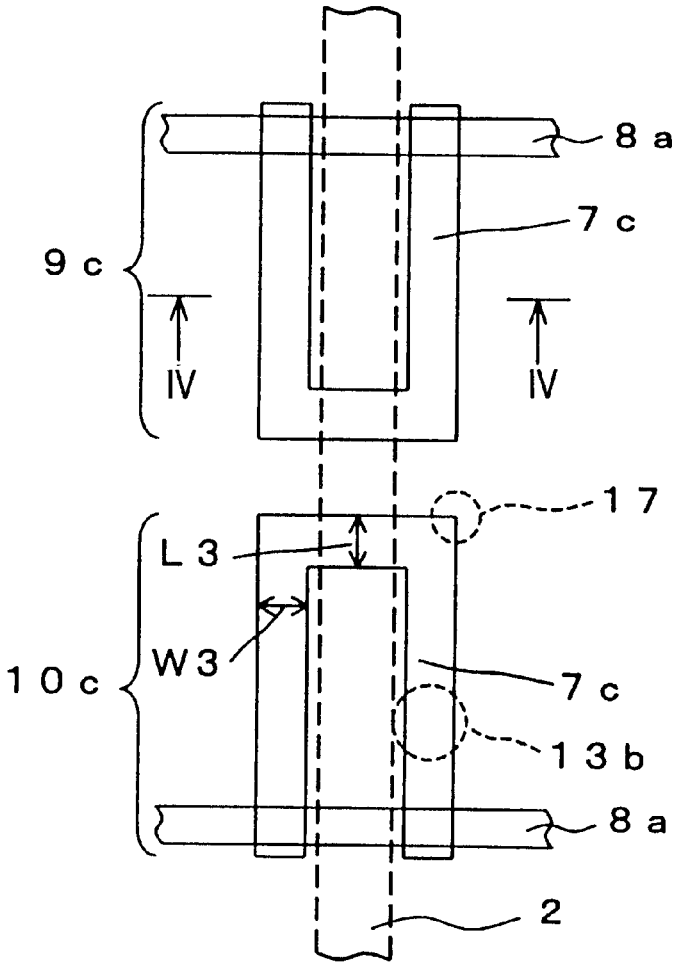
FIG. 4A (PRIOR ART)
FIG. 4A is a plan view of still other prior art plane electrodes, illustrating the structural arrangement thereof.
Figure 4B:
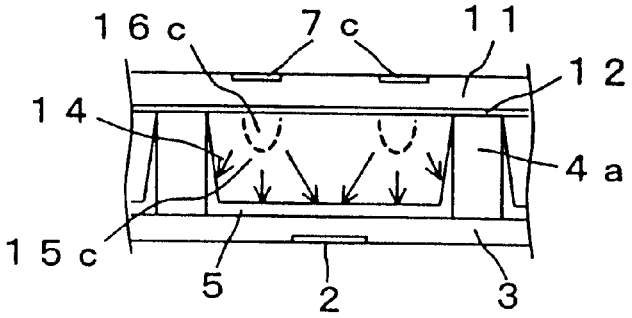
FIG. 4B (PRIOR ART)
FIG. 4B is a cross sectional view taken along line C—C in FIG. 4A.

With the structural arrangement of electrodes of this embodiment shown in FIG. 7, the plane electrodes do not have any rectangular corners (90°) along the outer edges thereof as shown in FIGS. 2 through 4. This arrangement brings about an auxiliary effect of alleviating various problems including that of degradation of the protection layer 12 due to local impacts of ions originated in a distorted electric field, that of fluctuations in the operating voltage due to the growth of conductive light shielding deposits and that of reduction of the luminance of emitted light. As a result, the panel can enjoy a prolonged service life than ever. The conductive light shielding deposits refers to metallic branch-like crystalline deposits containing lead (Pb) as principal ingredient and produced as sodium (Na) ions in the front substrate, which is made of soda lime glass, are segregated to the scan electrode side, which scan electrode is negatively biased longer than the common electrode, and made to grow by reducing PbO contained in the transparent dielectric layer of lead glass.

With the structural arrangement of electrodes of this embodiment shown in FIG. 7, while the capacity coupling between the plane electrodes 7*d* and the data electrode 2 increases, the area of the plane electrodes 7*d* does not increase. Therefore, the power consumption rate necessary for sustaining discharges does not increase. Opaque metal electrodes may be used for the plane electrodes of the present embodiment because the plane electrodes do not occupy a large area in each discharge cell unlike the rectangular plane electrodes shown in FIG. 2.

Figure 9:
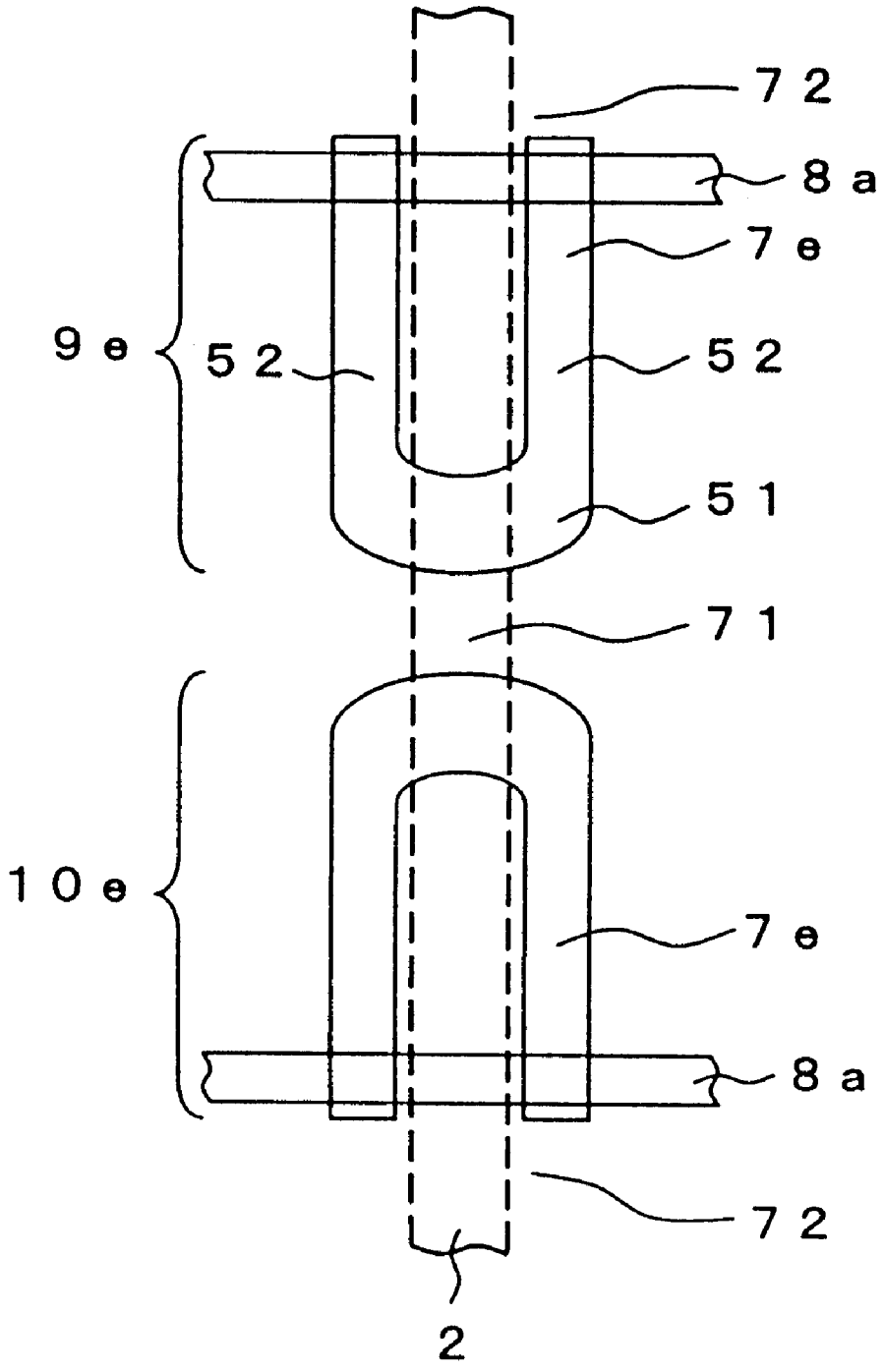
FIG. 9 is a plan view showing a modification of the plane electrodes of the first embodiment.

FIG. 9 is a plan view showing a first modification of the plane electrodes of the PDP according to the first embodiment of the present invention. The plane electrodes of FIG. 9 differ from those of FIG. 7 in that the inner edge of the front end (the first section 51) of each plane electrode is also curved and the highest point is found on the longitudinal central axis. In the plane electrodes shown in FIG. 9, the net result will be that the influence of wall charges along the longitudinal central axis of the cell can be emphasized at the front end of the plane electrodes in addition to the effect similar to that of the plane electrodes shown in FIG. 7. As a result, the display performance of the panel can be improved than that shown in FIG. 7.

Figure 10A:
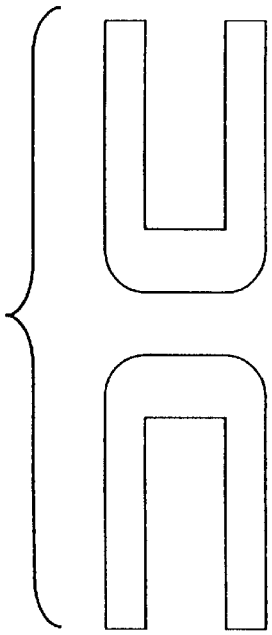
FIGS. 10A through 10C are plan views showing other modifications of the plane electrodes of the first embodiment.
Figure 10B:
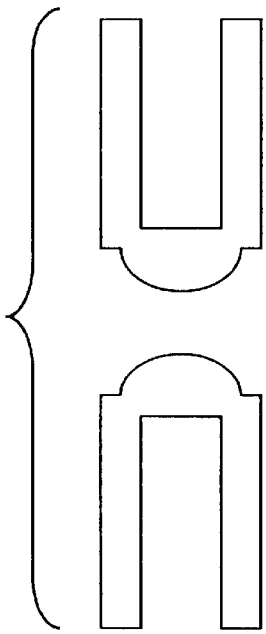
Figure 10C:
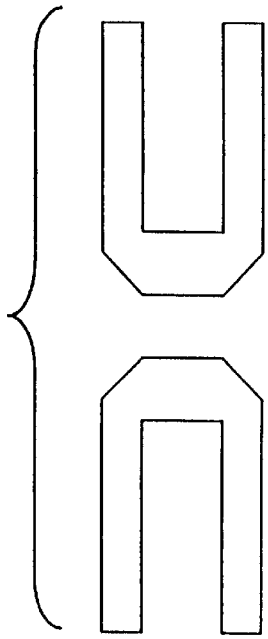

FIGS. 10A through 10C are plan views showing other modifications of the plane electrodes according to the first embodiment. The profile of the front end and that of the corners of the plane electrodes located near the discharging gap are not limited to those shown in FIGS. 7 and 9. Alternatively, the front end of each of the plane electrodes may linearly and transversally extends at the opposite side of the longitudinal central axis of the cell and the linear profile (near the longitudinal central axis of the cell) and the curved profile (at the corners of the plane electrode) may be combined at the corners as shown in FIG. 10A. Still alternatively, if the front end extends curvedly and transversally at the opposite sides of the longitudinal central axis of the cell, the curved profile and the linear profile (of the corners of the plane electrode) may be combined at the transversal opposite ends of the electrode as shown in FIG. 10B. Still alternatively, a plurality of obtuse angles (not smaller than 91° and smaller than 180°) may be combined at the transversal opposite ends of the electrode as shown in FIG. 10C. Any of the alternative profiles of FIGS. 10A through 10C provides effects similar to those of the first embodiment shown in FIGS. 7 and 9.

With the structural arrangement of electrodes of the first embodiment shown in FIGS. 7 and 9, it is possible to improve the color temperature and the color purity by reducing the difference in the operating voltage due to the difference in the fluorescent layers 5 and/or the coloring layers of the cells of red, green and blue by regulating the curvature of the curved profile lines, the length of the straight lines and/or the values and the number of the obtuse angles or by varying the ratio of the luminance values of emitted light of red, green and blue.

Additionally, with the structural arrangement of electrodes of the first embodiment shown in FIGS. 7 and 9, it is possible that discharges in the narrow gap area can trigger discharges in the wide gap areas to consequently improve the luminance of emitted light and the light emitting efficiency because the gap separating the plane electrodes in each cell, or the plane discharging gap 71, is broadened continuously or discontinuously. This is believed to be attributable to the phenomenon of positive column.

A positive column refers to a state of emission of light of plasma. Both the luminance of emitted light and the light emitting efficiency are improved as this state expands because ultraviolet rays are irradiated abundantly relative to the voltage fall in this state. A positive column grows as the distance between the electrodes is increased. It should be noted that the light emitting efficiency of a fluorescent lamp is high because it utilizes a positive column.

In the case of barrier discharges generated by applying an AC electric field to a dielectric layer as in a plasma display panel according to the present invention, wall charges are generated with the polarity opposite to that of the applied voltage on the surface of the dielectric layer formed on the plane electrode from the very start of discharges so that the effective applied voltage is varied with time and discharges become transitional until they eventually stop. Therefore, unlike DC discharges, a genuine positive column would not grow with barrier discharges. However, at instants before discharges transitionally change, barrier discharges behave like DC discharges so that an effect like that of a positive column can be obtained with barrier discharges as the discharging gap is broadened.

Embodiment 2

Figure 11:
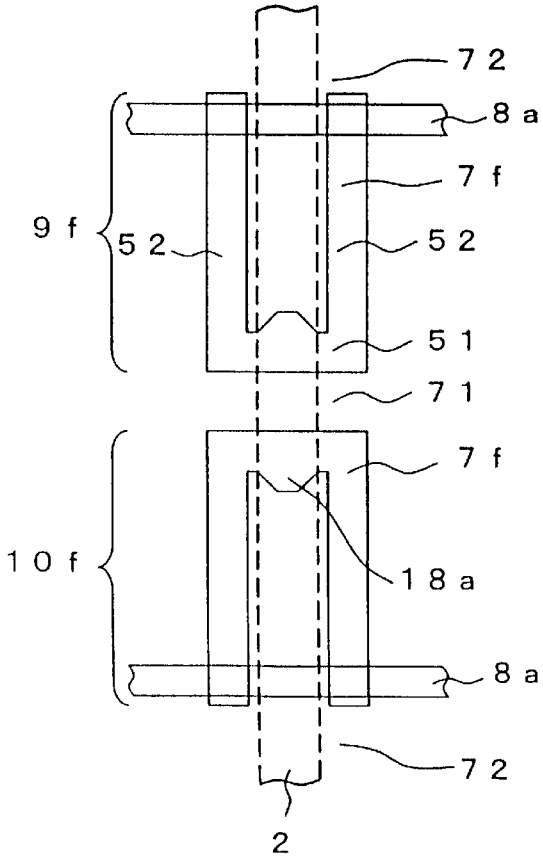
FIG. 11 is a plan view of plane electrodes of a plasma display panel according to a second embodiment of the present invention, illustrating the structural arrangement thereof.

FIG. 11 is a plan view of a pair of plane electrodes of a plasma display panel according to a second embodiment of the present invention, illustrating the structural arrangement thereof. As shown in FIG. 11, a pair of narrow and substantially U-shaped plane electrodes 7*f* are arranged in each cell. The plane electrodes 7*f* are connected to respective trace electrodes 8*a* at the open ends (near the non-discharging gaps 72) thereof and operate respectively as scan electrode 9*f* and common electrode 10*f*. The front ends or the closed ends (near the plane discharging gap 71) of the plane electrodes 7*f* define the plane discharging gap 71 between them. In this embodiment, the first section 51 of each plane electrode 7*f*, which is located at the side of the plane discharging gap 71, does not have any curved profile at the corners of the outer edges but the second section 52, which has lateral parts extending in the column direction along the opposite lateral sides of the data electrode 2, additionally has a projection 18*a* slightly projecting from the first section 51 toward the corresponding non-discharging gap 72.

Differently stated, in the embodiment shown in FIG. 11, the longitudinal projection 18*a* is provided at the inner edge of the first section 51 of each plane electrode 7*f* and projecting from the discharging gap side toward the non-discharging gap side. With this arrangement, the plane electrode 7*f* overlaps at the front end thereof the data electrode 2 over a large area to suppress the rise of the writing voltage and the fall of the writing rate. Additionally, the wall charges generated by writing discharges can be increased so that the panel can operate with a wide margin. Still additionally, the front end area of the plane electrode 7*f* overlapping the data electrode 2 can be maximized with this arrangement, thereby increasing the wall charges furthermore. As a result, it is possible to improve the distribution of wall charges on the plane electrode 7*f* and also the performance of transition from writing discharges to sustaining discharges.

Additionally, with the structural arrangement of the plane electrodes of the second embodiment shown in FIG. 11, the density of wall charges can be maximized to by turn maximize the probability of sustaining discharges on and near the longitudinal central axis of the cell. Then, preliminary discharges and sustaining discharges can be generated with a low voltage than ever to prevent the strong discharges in the preliminary phase and also in the initial stages of the sustaining discharge phase from significantly affecting longitudinal and transversal adjacent cells. As a result, the contrast of the displayed image can be improved and discharge interferences can be alleviated.

Still additionally, the structural arrangement of the plane electrodes of the second embodiment shown in FIG. 11 brings about an auxiliary effect of lowering the voltage for and raising the rate of writing discharges because of the trigger effect due to a distorted electric field generated along the edges of each plane electrode (an effect of distorting the electric field due to line of electric force concentrated along the edges of the plane electrode that increases the number of electrons captured by lines of electric force and the intensity of the electric field to encourage discharges) as the plane electrode overlaps the data electrode 2 in an increased area along the edges thereof. As a result, the display performance of the panel can be improved than ever.

Furthermore, with the structural arrangement of the plane electrodes of the second embodiment shown in FIG. 11, the capacity coupling between the plane electrodes 7*f* and the data electrode 2 increases but the ineffective area of the plane electrodes 7*f* does not increase to compensate the disadvantage of the increased capacity coupling.

Figure 12:
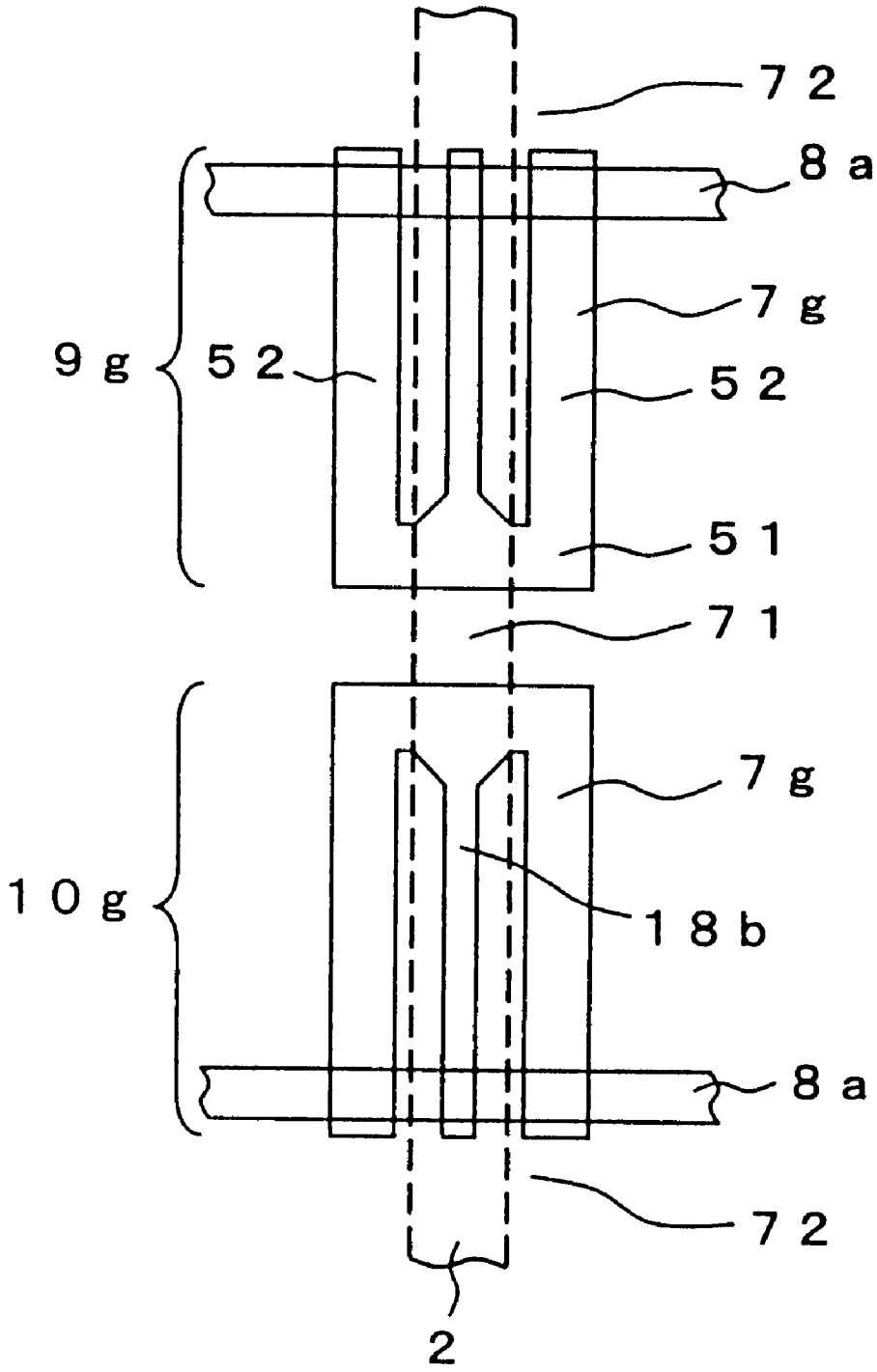
FIG. 12 is a plan view showing a modification of the plane electrodes of the second embodiment.

FIG. 12 is a plan view showing a modification of the plane electrodes of the PDP according to the second embodiment. The plane electrodes of FIG. 12 differ from those of FIG. 11 in that the projection 18*b* of each plane electrode projecting from the first section 51 toward the corresponding non-discharging gap 72 above the data electrode 2 gets narrowly to a position where it is connected to the corresponding trace electrode 8*a*. This arrangement provides advantages similar to those of the plane electrodes of FIG. 11 and an additional advantage of improving both the controllability and the luminance of emitted light of sustaining discharge plasma because sustaining discharge plasma can easily expand along the projection 18*b*. As a result, this arrangement of plane electrodes performs better than the one shown in FIG. 11.

The profile of the projection 18*a* or 18*b* shown in FIG. 11 or FIG. 12, whichever appropriate, is not limited to that of a frustum and may alternatively be triangular, rectangular or curved. Still alternatively, the projection may have a polygonal profile with a plurality of acute and/or obtuse angles or a profile realized by combining straight lines and curved lines. Plane electrodes having a projection showing such a profile bring about advantages similar to those of the arrangement of FIG. 11 or FIG. 12.

Additionally, with the structural arrangement of electrodes of the second embodiment shown in FIGS. 11 and 12, it is possible to improve the color temperature and the color purity by reducing the difference in the operating voltage due to the difference in the fluorescent layers 5 and/or the coloring layers of the cells of red, green and blue and/or changing the ratio of the luminance of emitted light of the colors by regulating the length and the width of the projection 18*a* or 18*b*. The operation of regulating the length and the width of the projection is simpler and easier than the corresponding regulating operation of the first embodiment.

The projection 18*a* or 18*b* of the arrangement of FIG. 11 or FIG. 12, whichever appropriate, may be replaced by a plurality of projections. When a plurality of projections are arranged above the data electrode 2 in each plane electrode, a remarkable effect of lowering the voltage for and raising the rate of writing discharges can be obtained because of the trigger effect of the edges of the plane electrode. The position of the projection is not limited to the longitudinal central axis of the cell because the effect is same so long as the projections are arranged in a front end area of the plane electrode that overlaps the corresponding data electrode 2. Additionally, the projections may be inclined instead of being directed vertically.

The arrangement (of projections) shown in FIG. 11 or FIG. 12 may be applied to any of the arrangements shown in FIGS. 7 through 10 to improve the performance thereof.

Embodiment 3

Figure 13:
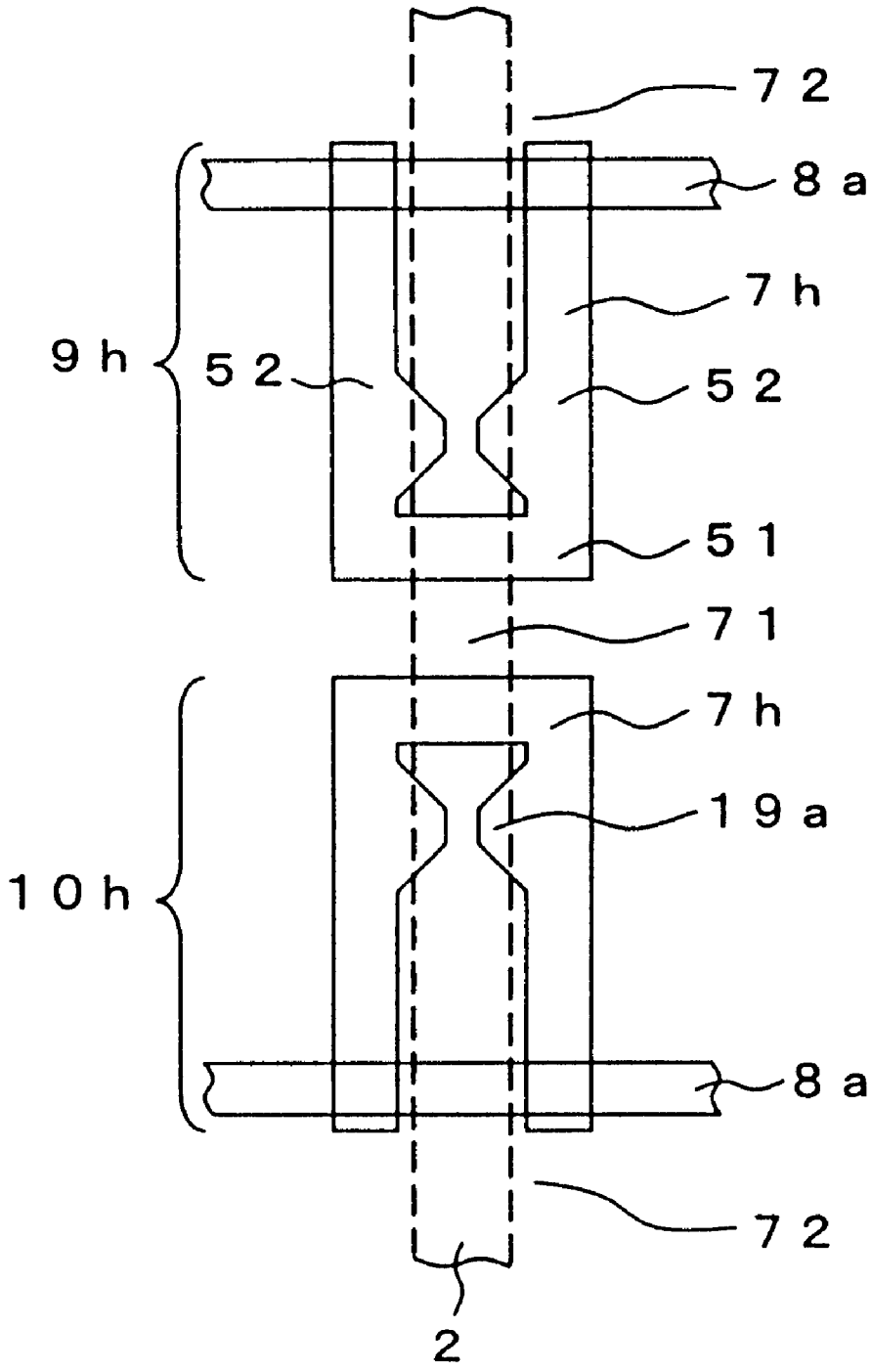
FIG. 13 is a plan view of plane electrodes of a plasma display panel according to a third embodiment of the present invention, illustrating the structural arrangement thereof.

FIG. 13 is a plan view of a pair of plane electrodes of a DP according to a third embodiment of the present invention, illustrating the structural arrangement thereof. As shown in FIG. 13, a pair of narrow and substantially U-shaped plane electrodes 7*h* are arranged in each cell. The plane electrodes 7*h* are connected to respective trace electrodes 8*a* at the open ends (near the non-discharging gaps) thereof and operate respectively as scan electrode 9*h* and common electrode 10*h*. The front ends or the closed ends (near the plane discharging gap) of the plane electrodes 7*h* define the plane discharging gap 71 between them.

In each of the plane electrodes of the third embodiment shown in FIG. 13, a pair of transversal projections 19*a* project toward each other, or toward the longitudinal central axis of the cell, from the opposite edges of the oppositely disposed parts of the second section 52, which are extending from the first section 51 toward the corresponding non-discharging gap 72 along the lateral edges of the data electrode 2. With this arrangement, the plane electrode 7*h* overlaps the data electrode 2 over an increased area in the second section 52 of the plane electrode 7*h* to suppress the rise of the writing voltage and the fall of the writing rate. Additionally, the wall charges generated by writing discharges can be increased so that the panel can operate with a wide margin. Still additionally, since wall charges are generated not only in the first section 51 of the plane electrode 7*h* but also in the area of the plane electrode 7*h* located above the data electrode 2 at the side of the corresponding non-discharging gap 72, the amount of all charges can be maximized on and near the longitudinal central axis of the cell. As a result, it is possible to improve the distribution of wall charges on the plane electrode 7*h* and also the performance of transition from writing discharges to sustaining discharges.

Additionally, with the structural arrangement of the plane electrodes of the third embodiment shown in FIG. 13, the density of wall charges can be maximized to by turn maximize the probability of sustaining discharges on and near the longitudinal central axis of the cell. Then, preliminary discharges and sustaining discharges can be generated with a low voltage than ever to prevent the strong discharges in the preliminary phase and also in the initial stages of the sustaining discharge phase from significantly affecting longitudinal and transversal adjacent cells. As a result, the contrast of the displayed image can be improved and discharge interferences can be alleviated.

Still additionally, the structural arrangement of the plane electrodes of the second embodiment shown in FIG. 13 brings about an auxiliary effect of lowering the voltage for and raising the rate of writing discharges because of the trigger effect due to a distorted electric field generated along the edges of each plane electrode as the plane electrode overlaps the data electrode 2 in an increased area along the edges thereof. As a result, the display performance of the panel can be improved than ever.

Furthermore, with the structural arrangement of the plane electrodes of the second embodiment shown in FIG. 13, the capacity coupling between the plane electrodes 7*h* and the data electrode 2 increases but the ineffective area of the plane electrodes 7*h* does not increase to compensate the disadvantage of the increased capacity coupling.

Figure 14:
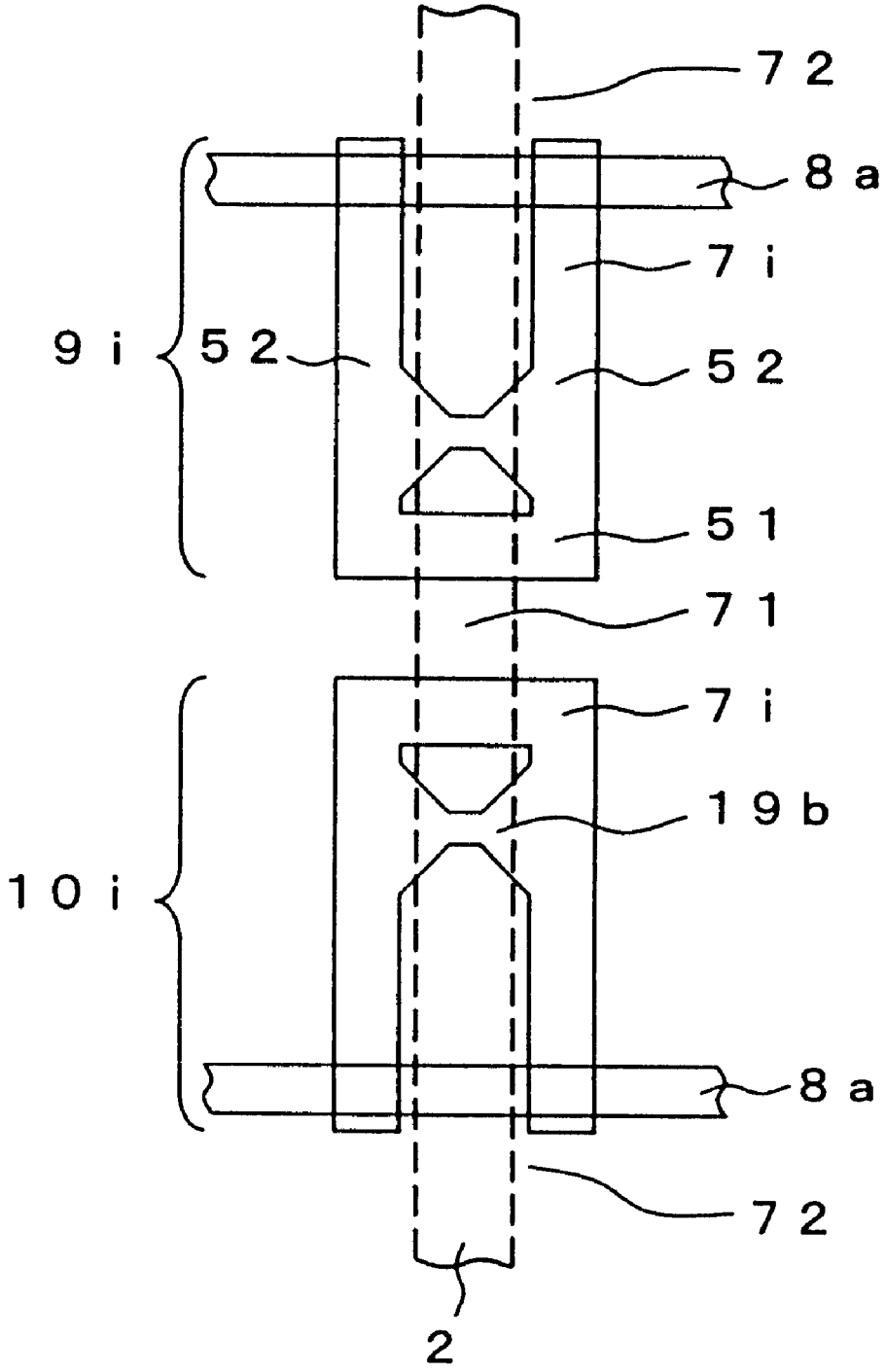
FIG. 14 is a plan view showing a modification of the plane electrodes of the third embodiment.

FIG. 14 is a plan view showing a modification of the plane electrodes according to the third embodiment of the present invention. The plane electrodes of FIG. 14 differ from those of FIG. 13 in that the projections 19*b* of each plane electrode are connected to each other. This arrangement provides advantages similar to those of the plane electrodes of FIG. 13 and an additional advantage of improving both the controllability and the luminance of emitted light of sustaining discharge plasma because sustaining discharge plasma can easily expand along the projections 19*b*. As a result, this arrangement of plane electrodes performs better than the one shown in FIG. 13.

The profile of the projections 19*a* or 19*b* shown in FIG. 13 or FIG. 14, whichever appropriate, is not limited to that of a frustum and may alternatively be triangular, rectangular or curved. Still alternatively, the projections may have a polygonal profile with a plurality of acute and/or obtuse angles or a profile realized by combining straight lines and curved lines. Plane electrodes having projections showing such a profile bring about advantages similar to those of the arrangement of FIG. 13 or FIG. 14.

Additionally, with the structural arrangement of electrodes of the third embodiment shown in FIGS. 13 and 14, it is possible to improve the color temperature and the color purity by reducing the difference in the operating voltage due to the difference in the fluorescent layers 5 and/or the coloring layers of the cells of red, green and blue and/or changing the ratio of the luminance of emitted light of the colors by regulating the length and the width of the projections 19*a* or 19*b*. The operation of regulating the length and the width of the projection is simpler and easier than the corresponding regulating operation of the first embodiment.

The projections 19*a* or 19*b* of the arrangement of FIG. 11 or FIG. 12, whichever appropriate, may be replaced by a plurality of projections. When the plurality of projections are arranged above the data electrode 2 at the front end of each plane electrode, a remarkable effect of lowering the voltage for and raising the rate of writing discharges can be obtained because of the trigger effect of the edges of the plane electrode. The positions of the projections are not limited to plane discharging gap side. When projections are arranged at the corresponding non-discharging gap side, sustaining discharge plasma can expand more easily because the potential distribution is improved at the time of sustaining discharges. The projections do not need to be directed horizontally and may alternatively directed in inclined directions. Still alternatively, the projections may be arranged with shift. The arrangement (of projections) shown in FIG. 13 or FIG. 14 may be applied to any of the arrangements shown in FIGS. 7 through 10 to improve the performance thereof.

Embodiment 4

Figure 15:
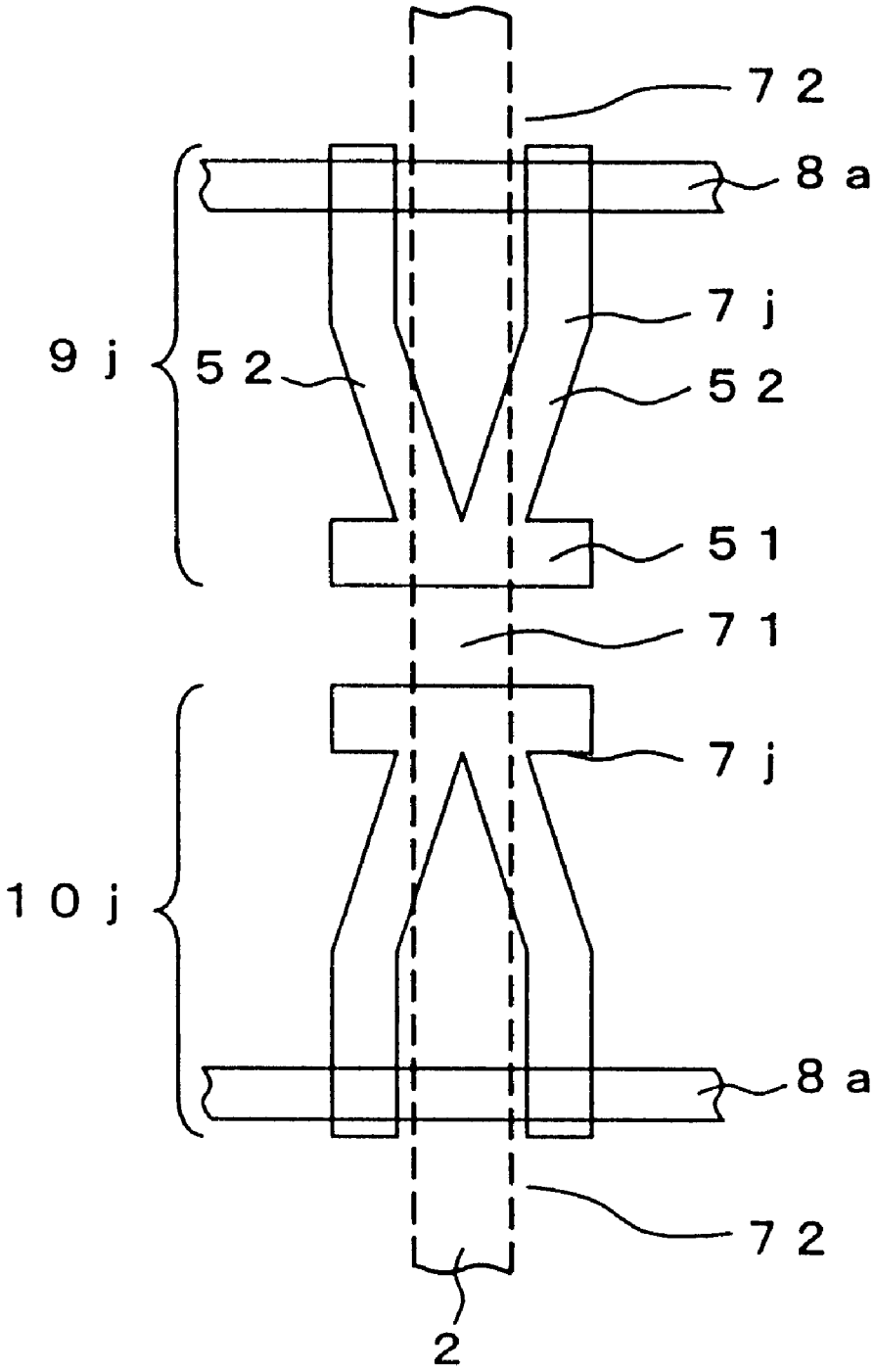
FIG. 15 is a plan view of plane electrodes of a plasma display panel according to a fourth embodiment of the present invention, illustrating the structural arrangement thereof.

FIG. 15 is a plan view of a pair of plane electrodes of a PDP according to a fourth embodiment of the present invention, illustrating the structural arrangement thereof. As shown in FIG. 15, a pair of narrow and substantially π-shaped plane electrodes 7*j* are arranged in each cell. The plane electrodes 7*j* are connected to respective trace electrodes 8*a* at the second sections 52 of the open ends (near the non-discharging gaps) thereof and operate respectively as scan electrode 9*j* and common electrode 10*j*. The first sections 51 of the closed ends (near the plane discharging gap) of the plane electrodes 7*j* or the front ends define the plane discharging gap 71 between them.

As shown in FIG. 15, in each of the plane electrodes 7*j* of each cell of this embodiment, the second section 52 has inclined parts extending aslant from a position on the longitudinal central axis of the cell of the first section 51 to respective lateral parts extending longitudinally along the opposite lateral sides of the data electrode 2. With this arrangement, the plane electrode 7*j* overlaps at the front end thereof the data electrode 2 over a large area to suppress the rise of the writing voltage and the fall of the writing rate.

Additionally, the wall charges generated by writing discharges can be increased so that the panel can operate with a wide margin. Still additionally, the front end area of the plane electrode 7*j* overlapping the data electrode 2 can be increased than ever with this arrangement. As a result, it is possible to improve the distribution of wall charges on the plane electrode 7*j* and also the performance of transition from writing discharges to sustaining discharges.

Additionally, with the structural arrangement of the plane electrodes of the second embodiment shown in FIG. 15, the density of wall charges can be maximized to by turn maximize the probability of sustaining discharges on and near the longitudinal central axis of the cell. Then, preliminary discharges and sustaining discharges can be generated with a low voltage than ever to prevent the strong discharges in the preliminary phase and also in the initial stages of the sustaining discharge phase from significantly affecting longitudinal and transversal adjacent cells. Particularly, the coupling of the plane electrodes 7*j* of transversally adjacent cells can be reduced to suppress the diffusion of plasma to transversally adjacent cells. As a result, the contrast of the displayed image can be improved and discharge interferences can be alleviated.

Still additionally, the structural arrangement of the plane electrodes of the second embodiment shown in FIG. 15 brings about an auxiliary effect of lowering the voltage for and raising the rate of writing discharges because of the trigger effect due to a distorted electric field generated along the edges of each plane electrode as the plane electrode overlaps the data electrode 2 in an increased area along the edges thereof. As a result, the display performance of the panel can be improved than ever.

Furthermore, with the structural arrangement of the plane electrodes of the second embodiment shown in FIG. 15, the capacity coupling between the plane electrodes 7*j* and the data electrode 2 increases but the ineffective area of the plane electrodes 7*j* does not increase to compensate the disadvantage of the increased capacity coupling.

Figure 16:
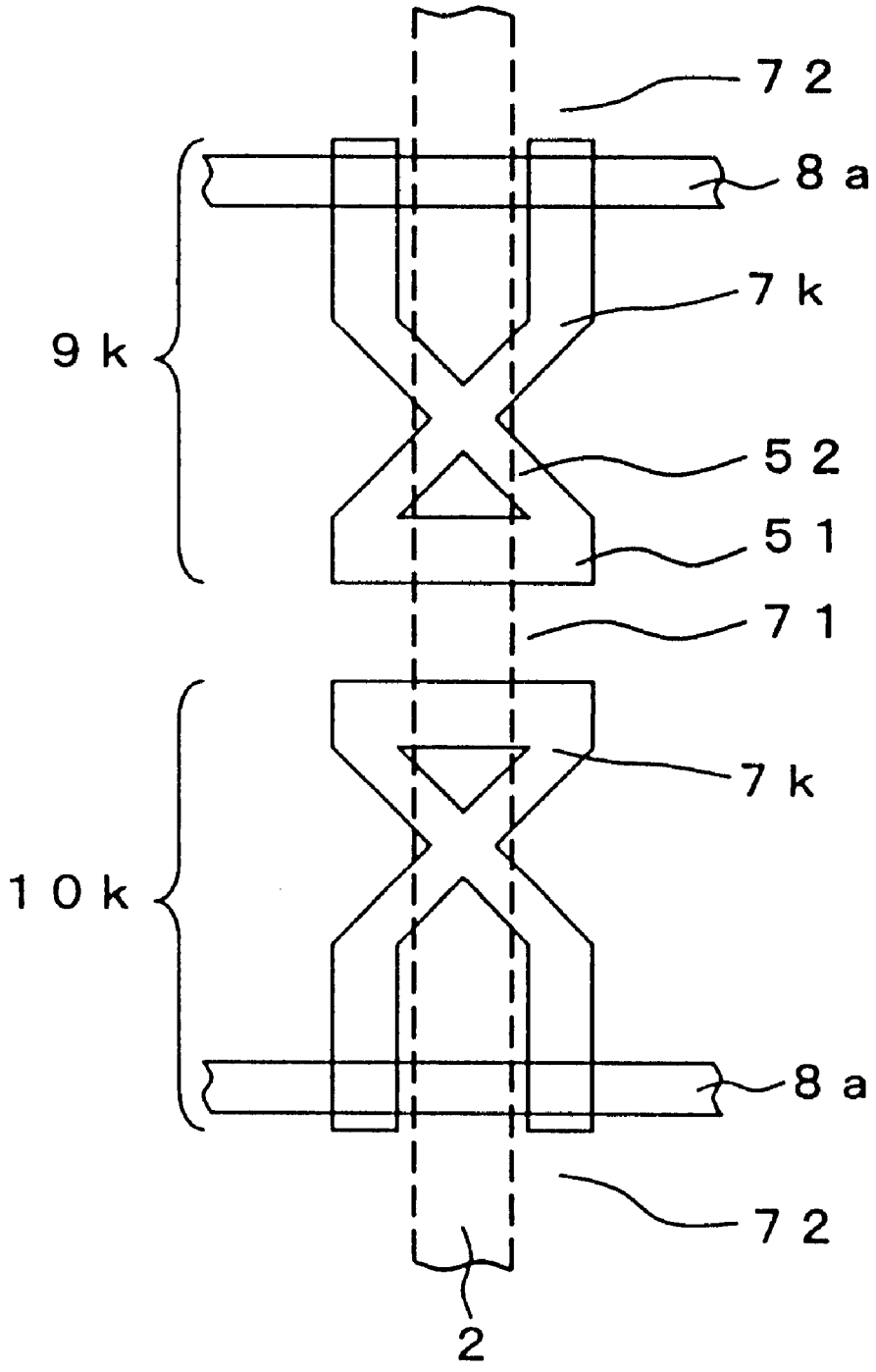
FIG. 16 is a plan view showing a modification of the plane electrodes of the fourth embodiment.

FIG. 16 is a plan view showing a modification of the plane electrodes according to the third embodiment of the present invention. The plane electrodes 7*k* of FIG. 16 differ from the plane electrodes 7*j* of FIG. 15 in that the inclined parts of the second section 52 of each of the plane electrodes 7*k* extend respectively from the corresponding transversal ends of the first section 51 to the lateral parts longitudinally extending along the lateral sides of the data electrode after crossing each other. In other words, the inclined parts of the second section 52 are arranged to form the profile of letter "X" as viewed from above. This arrangement provides advantages similar to those of the plane electrodes 7*j* of FIG. 15 and an additional advantage of improving both the controllability and the luminance of emitted light of sustaining discharge plasma because wall charges are generated not only on the first section 51 at the front end of each of the plane electrodes 7*k* located close to the discharging gap but also in areas close to the non-discharging gap to allow sustaining discharge plasma to easily expand. As a result, this arrangement of plane electrodes performs better than the one shown in FIG. 15.

The inclined parts of the electrodes shown in FIG. 15 or FIG. 16 may alternatively have respective vertically or horizontally extending areas to show a hooked profile.

Additionally, with the structural arrangement of electrodes of the fourth embodiment shown in FIGS. 15 and 16, it is possible to improve the color temperature and the color purity by reducing the difference in the operating voltage due to the difference in the fluorescent layers 5 and/or the coloring layers of the cells of red, green and blue and/or changing the ratio of the luminance of emitted light of the colors by regulating the length, the width and the angle of crossing of the inclined parts of the electrodes as described above by referring to the first embodiment.

There are no limitations to the number of inclined parts and that of crossings of the electrodes of the embodiment shown in FIG. 15 or 16. When those numbers are increased, a remarkable effect of lowering the voltage for and raising the rate of writing discharges can be obtained because of the trigger effect of the edges of the plane electrode. The positions of the inclined parts are not also limited and the same effect can be obtained so long as the inclined parts are arranged in a front end area of the plane electrode that overlaps the corresponding data electrode 2.

The arrangement shown in FIG. 15 or FIG. 16 may be applied to any of the arrangements (or the profiles of the front ends of the plane electrodes) shown in FIGS. 7 through 10 to improve the performance thereof.

Embodiment 5

Figure 17:
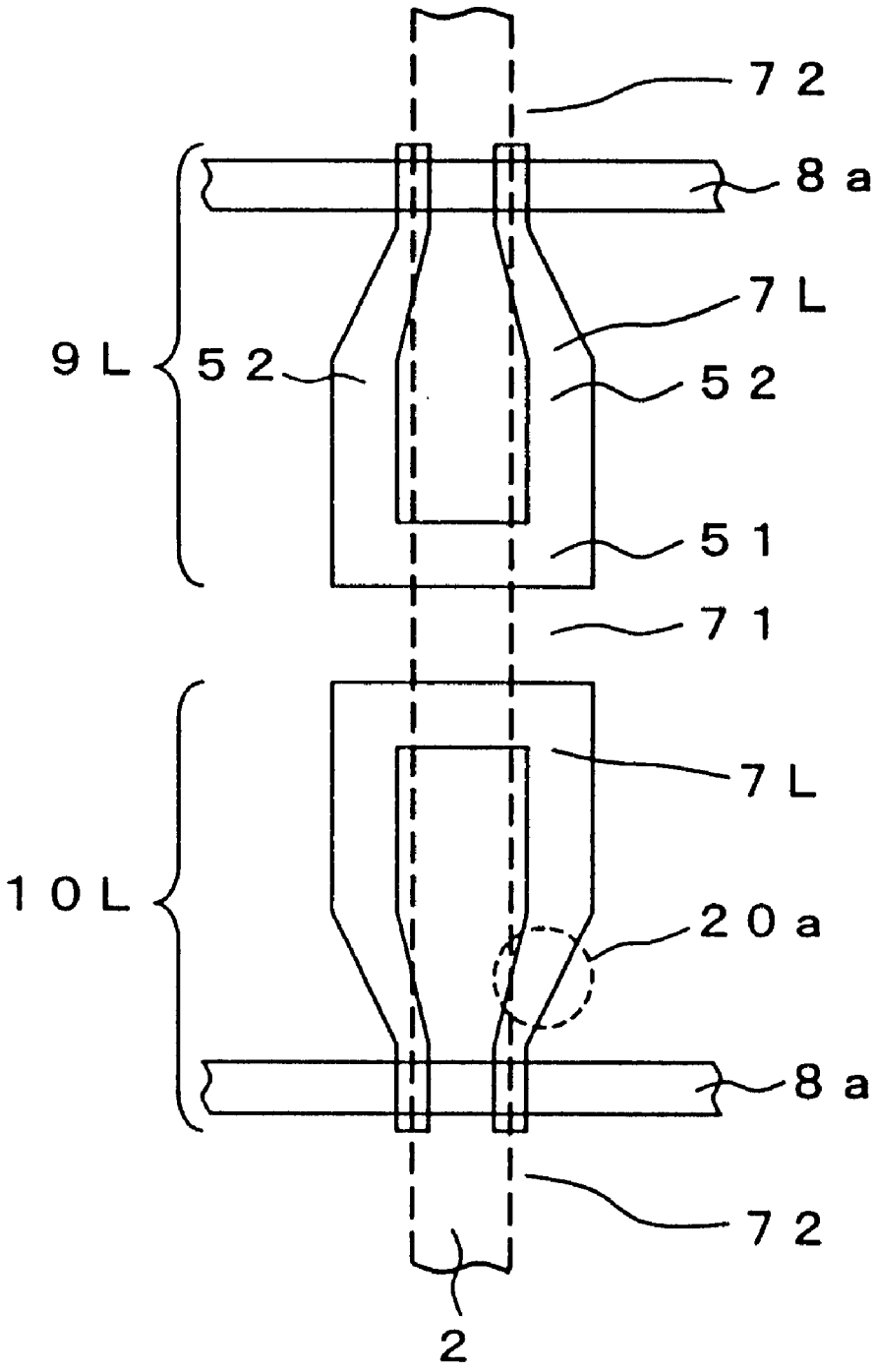
FIG. 17 is a plan view of plane electrodes of a plasma display panel according to a fifth embodiment of the present invention, illustrating the structural arrangement thereof.

FIG. 17 is a plan view of a pair of plane electrodes of a plasma display panel according to a fifth embodiment of the present invention, illustrating the structural arrangement thereof. As shown in FIG. 17, a pair of narrow and substantially U-shaped plane electrodes 7L are arranged in each cell. The second section 52 at the open end (located close to non-discharging gap) of each of the plane electrodes 7L is connected to a corresponding trace electrode 8*a*. The plane electrodes 7L operate respectively as scan electrode 9L and common electrode 10L. The first sections 51 at the front ends or the closed ends (located close to the plane discharging gap) of the plane electrodes 7L define the plane discharging gap 71 between them.

The second section 52 of each of the plane electrodes 7L of the fifth embodiment shown in FIG. 17 has lateral parts longitudinally extending along the respective lateral sides of the corresponding data electrode 2 and tapered parts 20*a* which are inclined and extending from the respective lateral parts toward the corresponding trace electrode 8*a* so as to come closer toward the longitudinal central axis of the cell. With this arrangement, the potential distribution that influences the effect of sustaining discharges is converged gradually as the tapered parts approach the longitudinal central axis of the cell so that sustaining discharge plasma can easily be converged with the potential distribution. As a result, discharge interferences among longitudinally and transversally adjacent cells can be alleviated than ever.

Figure 18:
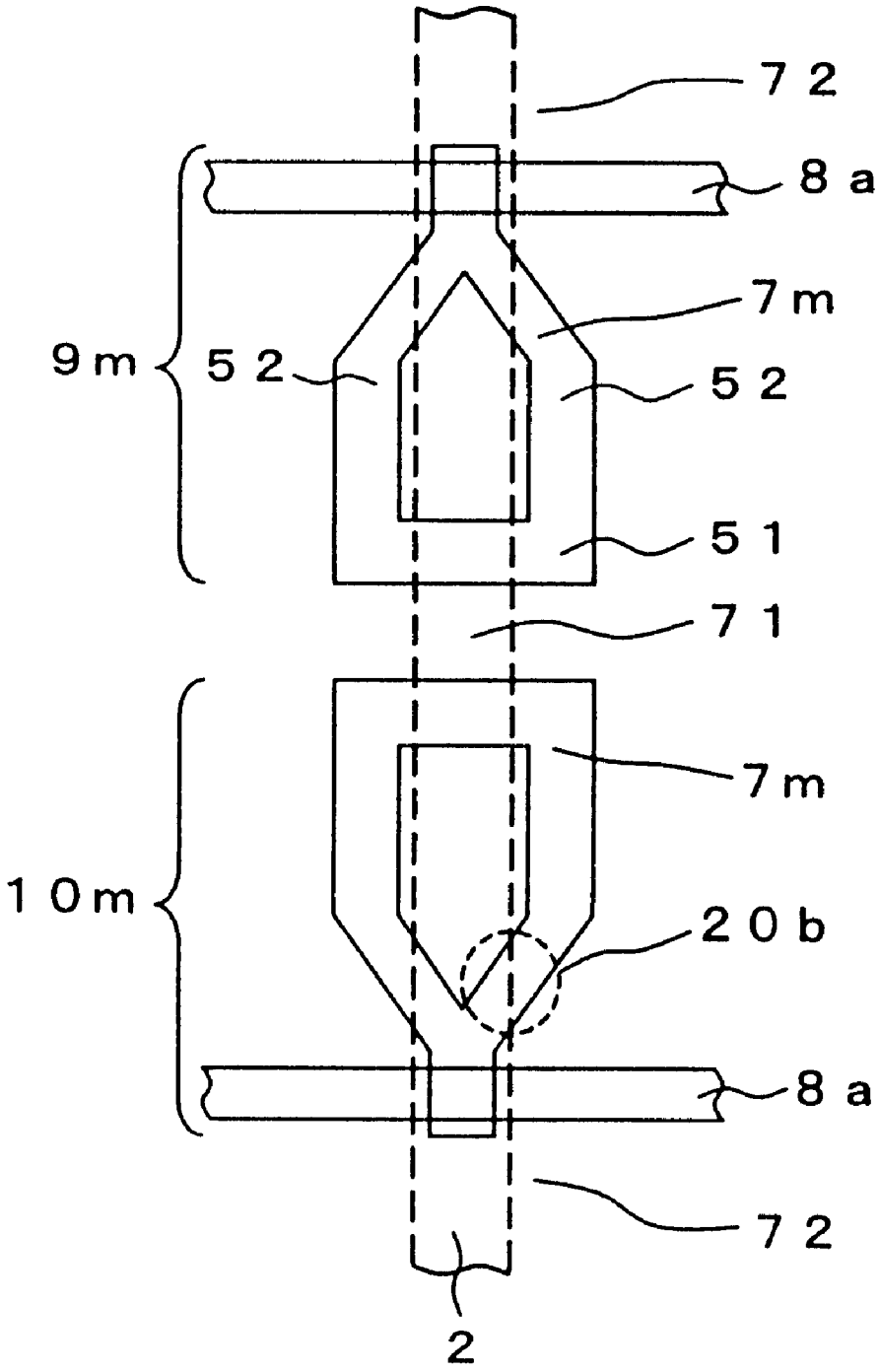
FIG. 18 is a plan view showing a modification of the plane electrodes of the fifth embodiment.

FIG. 18 is a plan view showing a first modification of the plane electrodes of the fifth embodiment. The plane electrodes 7*m* shown in FIG. 18 differ from the plane electrodes 7L of FIG. 17 in that the pair of tapered parts 20*b* of each of the plane electrodes 7*m* are connected to each other above the corresponding data electrode as viewed from above and then commonly connected to the corresponding trace electrode 8*a* at a single point. In other words, the plane electrodes 7*m* have a closed profile and the tapered parts 20*b* of each of the plane electrodes 7*m* are linked to each other in this modification. This arrangement provides advantages similar to those of the plane electrodes 7L of FIG. 17 and an additional advantage of improving the controllability of plasma because sustaining discharge plasma can easily be converged. As a result, this arrangement of plane electrodes performs better than that of plane electrodes 7L shown in FIG. 17.

The profile of the tapered parts 20*a* or 20*b* shown in FIG. 17 or FIG. 18, whichever appropriate, is not limited to the illustrated one and may alternatively be curved. Still alternatively, the tapered parts may have a profile of a combination of a plurality of obtuse angles. Plane electrodes having tapered parts showing such a profile bring about advantages similar to those of the arrangement of FIG. 17 or FIG. 18.

The arrangement (of tapered parts) shown in FIG. 17 or FIG. 18 may be applied to any of the arrangements shown in FIGS. 7 through 10 to improve the performance thereof.

Additionally, the performance of the plane electrodes of the cells of the PDP according to the invention can be further improved by applying both the structural arrangement (of the profile of the front ends of the plane electrodes) shown in any of FIGS. 7 through 10 and the one (of tapered parts) shown in FIG. 17 or FIG. 18 to any of the arrangements shown in FIGS. 11 through 14.

The present invention is characterized maximally by the arrangement where all the possible spatial roles of plane electrodes are appropriately incorporated. Therefore, various effects and advantages can be realized by combining any of the above-described structural arrangements of the present invention. In other words, a desired performance can be realized with ease by combining any of the structural arrangements illustrated in FIGS. 7 through 18. It will be appreciated that the performance of a PDP can be improved by partly applying the present invention to the prior art.

Figure 19A:
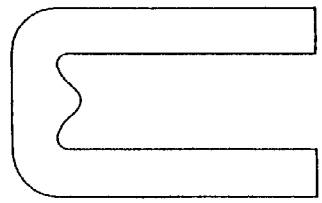
FIGS. 19A through 19J are plan views of plane electrodes obtained by combining some of the structural arrangements according to the present invention.
Figure 19B:
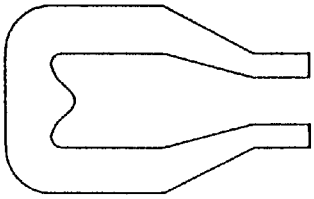
Figure 19C:
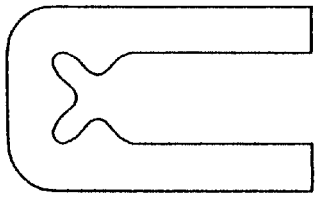
Figure 19D:
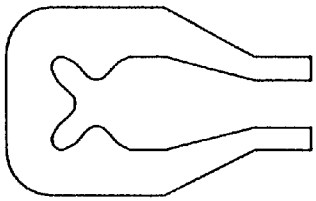
Figure 19E:
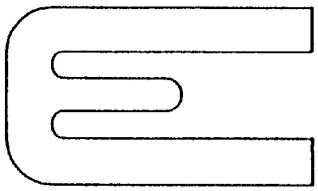
Figure 19F:
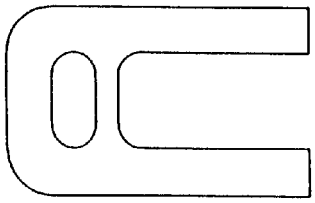
Figure 19G:
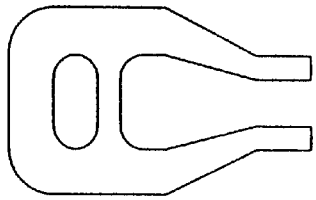
Figure 19H:
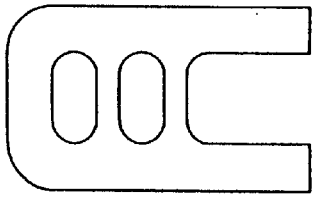
Figure 19I:
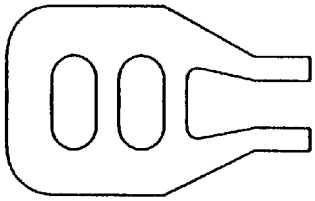
Figure 19J:
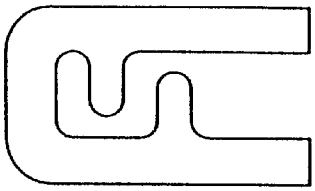

FIGS. 19A through 19J are plan views of plane electrodes obtained by combining some of the structural arrangements according to the invention. For example, FIG. 19A shows an arrangement realized by combining those of FIG. 10A and FIG. 11. FIG. 19B shows an arrangement realized by combining those of FIG. 10A, FIG. 11 and FIG. 17. FIG. 19C shows an arrangement realized by combining those of FIG. 10A, FIG. 11 and FIG. 13. FIG. 19D shows an arrangement realized by combining those of FIG. 10A, FIG. 11, FIG. 13 and FIG. 17. FIG. 19E shows an arrangement realized by combining those of FIG. 10A and FIG. 11 and extending the longitudinal projection of each plane electrode to a position not connected to the corresponding trace electrode 8*a*. FIG. 19F shows an arrangement realized by combining those of FIG. 10A and FIG. 14. FIG. 19G shows an arrangement realized by combining those of FIG. 10A, FIG. 14 and FIG. 17. FIG. 19H shows an arrangement realized by combining those of FIG. 10A and FIG. 14 and providing two pairs of mutually connected transversal projections. FIG. 19I shows an arrangement realized by combining those of FIG. 10A, FIG. 14 and FIG. 17 and also providing two pairs of mutually connected transversal projections. FIG. 19J shows an arrangement realized by combining those of FIG. 10A and FIG. 13 and arranging transversal projections with shift.

Embodiment 6

Figure 20:
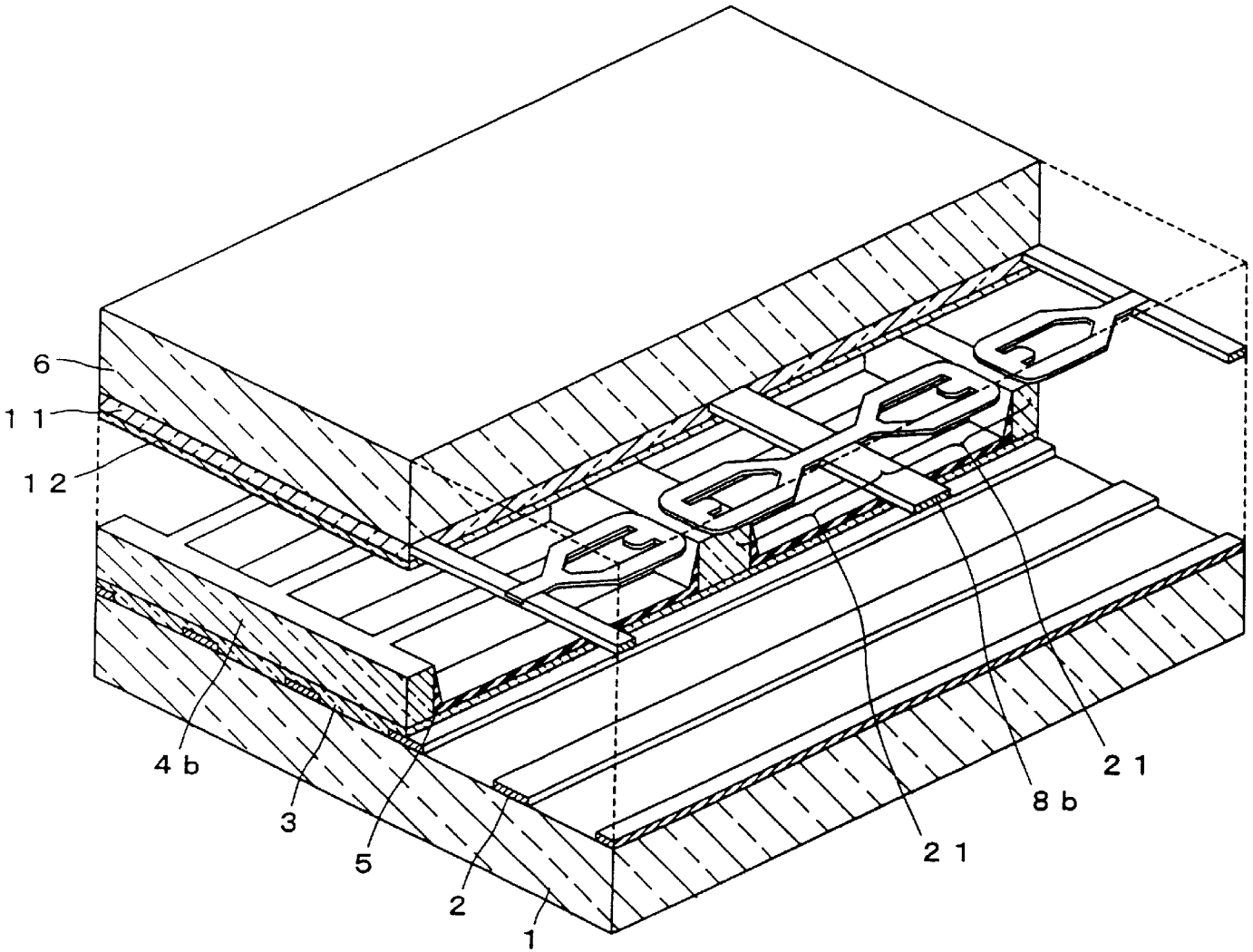
FIG. 20 is a partly cut out perspective view of a plasma display panel according to a sixth embodiment of the present invention.

FIG. 20 is a partly cut out schematic perspective view of a plasma display panel according to a sixth embodiment of the present invention. The panel shows a configuration substantially same as that of the prior art PDP shown in FIG. 1. However, partition walls 4*b* are provided to form a lattice that surrounds the four sides of the unit cells in this embodiment. In other words, there are partition walls running in the column (longitudinal) direction and those running in the row (transversal) direction that intersect each other to form a lattice and each square space defined by the partition walls contains a unit cell in it. The plane electrodes 21 of this embodiment has a profile realized by combining those shown in FIG. 7, FIG. 11 and FIG. 18. Additionally, the pair of plane electrodes 21 of two cells that are adjacently located in the longitudinal (column) direction are integrally formed and connected to the common trace electrode 8*b* arranged between the cells.

Figure 1:
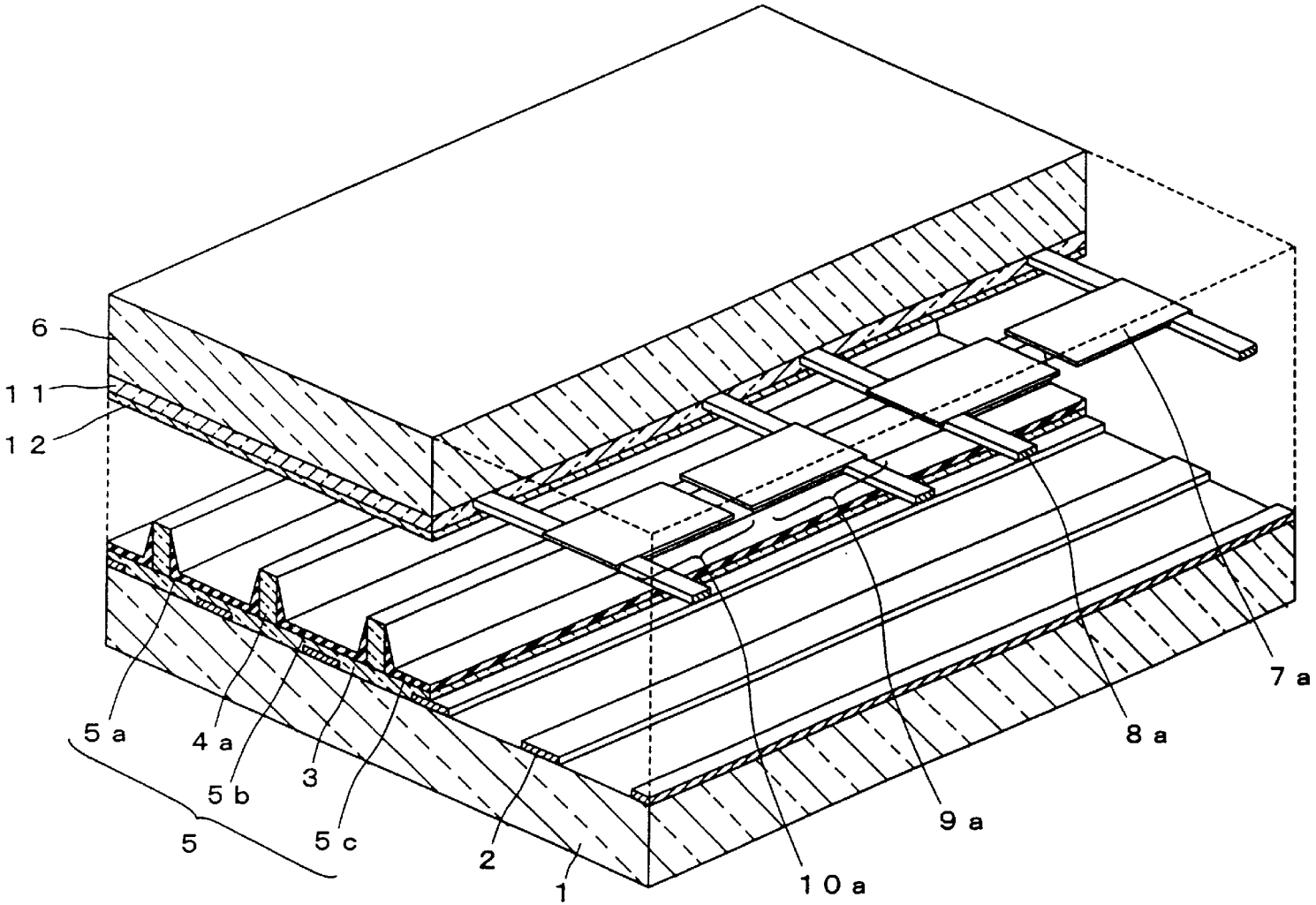
FIG. 1 (PRIOR ART)
FIG. 1 is a partly cut out schematic perspective view of a prior art plasma display panel.

A PDP having the configuration of FIG. 20 is free from non-discharging gaps, which are inevitable present in the known PDP of FIG. 1 and hence the plane electrodes 21 of the PDP can be formed over a wide area in the cells. As a result, the cells are allowed to have large openings so as to increase the volume of sustaining discharge plasma in order to improve the luminance of emitted light and the light emitting efficiency.

The sixth embodiment of PDP shown in FIG. 20 operates in a manner as described below by referring to FIG. 21, which is a timing chart illustrating the method for driving the PDP of the sixth embodiment. Signals $E_1$, $E_2$, $E_3$, $E_4$, $E_5$, $E_6$, . . . are applied to the respective trace electrodes 8*b* arranged in the column direction and signal Dj is applied to the data electrodes 2 running in the column direction. Assume that, of the pair of plane electrodes 21 commonly connected to one of the trace electrodes and arranged adjacently in the longitudinal (column) direction, the one located upstream in the longitudinal direction operates as scan electrode and the other located downstream operates as common electrode. Also assume that, while the scan electrode and the common electrode show the same and identical profile as illustrated in FIG. 15, the voltage for starting opposite discharges between the plane electrode 21 operating as scan electrode and the data electrode is made lower than the voltage for starting opposite discharges between the plane electrode 21 operating as common electrode and the data electrode by differentiating the thickness of protection film between the two plane electrodes 21 or the like. Then, as a pulse is applied to the trace electrode 8*b* to which signal $E_1$ is applied, opposite discharges occur only between the data electrode and the plane electrode (scan electrode) located upstream in the column direction out of the pair of plane electrodes 21, which are commonly connected to the trace electrode 8*b* and arranged adjacently in the column direction.

Figure 21:
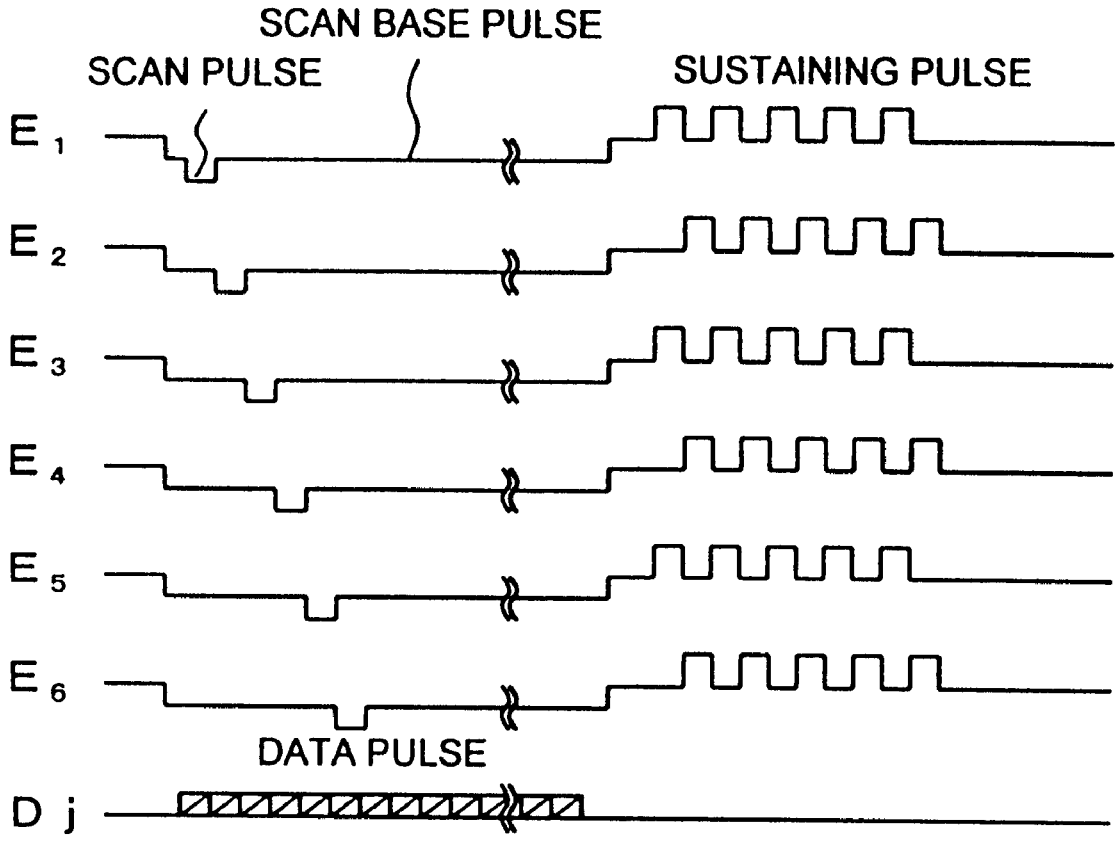
FIG. 21 is a timing chart illustrating a method for driving the PDP according to the sixth embodiment.

Referring to FIG. 21, in a writing period, the driving unit firstly applies scan pulses sequentially from the top scan electrode in the vertical direction, to the top scan electrode the signal $E_1$ is applied, and then applies a data pulse having the polarity opposite to that of the scan pulses to the data electrode D1 in synchronization with the scan pulses according to the display data. Since the plane electrode 21 located upstream relative to the corresponding trace electrode 8*b* may generate opposite discharges with the data electrode 2 at a voltage lower than the voltage for starting electric discharges of the downstream plane electrode 21, only the upstream plane electrode can be made to generate writing discharges by appropriately selecting the scan pulse voltage and the data pulse voltage.

For example, when data pulses are applied to the selected data electrodes according to the display data of the third row when applying the scan pulse of signal $E_3$ and the other data electrodes are held to the ground potential, opposite discharges occur between the selected data electrodes and the corresponding plane electrodes and wall charges are generated near the selected plane electrode. At this time, no opposite discharges occur between the plane electrode 21 operating as a common electrode and the data electrode although a scan pulse is applied between them with the same voltage. Thus, no wall charges are generated near the plane electrode 21 of the display cell operating as the common electrode although the scan pulse is applied to the plane electrode 21. Additionally, since the pair of plane electrodes 21 commonly connected a single trace electrode and arranged adjacently in the column direction, one of which operates as a scan electrode and the other of which operates as a common electrode, are separated by a horizontal partition wall, discharges generated in the display cell of the plane electrode operating as the scan electrode do not expand into the display cell of the plane electrode operating as the common electrode.

After the end of a writing phase, the driving unit applies a sustaining discharge pulse to both of the plane electrodes as shown in FIG. 21. More specifically, the sustaining discharge pulse is applied alternately between the adjacent trace electrodes 8*b* so that an AC pulse may be applied and plane discharges may occur between the plane electrode operating as the scan electrode and the plane electrode operating as the common electrode that are arranged oppositely with a plane discharging gap disposed between them. The sustaining discharges in a display cell do not affect the display cells arranged adjacently in the longitudinal direction because of the horizontal partition walls. Similarly, because of the provision of vertical partitions and the profile of the plane electrodes that makes them to be separated in the transversal direction, no interferences occur between any two transversally adjacent display cells. Thus, a full color image is displayed by repeating the sequence of operation for each sub-field.

It may be appreciated that the longitudinally adjacently arranged two plane electrodes may have different profiles so that writing discharges may occur only on one of the surface substrates.

The present invention is characterized in that narrow plane electrodes are arranged efficiently and effectively to fulfill their spatial roles. Therefore, the width, the length and the number of plane electrodes of the PDP according to the invention may be appropriately selected. In other words, there are no limitations to the structural arrangement of plane electrodes as long as the plane electrodes are arranged according to the invention. Then, the total surface area of the plane electrodes can be reduced than ever without significantly reducing the ratio of the open area to the total surface area of the cells if the plane electrodes are made of metal instead of a conventional transparent electrically conductive material. Thus, the manufacturing steps relating to the formation of plane electrodes (including a step of forming transparent plane electrodes for the purpose of securing the area to be used for sustaining discharges and a step of forming trace electrodes for the purpose of reducing the wiring resistance of the panel) can be combined for simplification to consequently improve the manufacturing yield and reducing the manufacturing cost. As a result, it is possible to provide low cost PDPs than ever.

While the plane electrodes of the embodiments shown in FIG. 7 through FIG. 21 are arranged in an isolated manner like so many islands and linked in the transversal direction by trace electrodes, they may alternatively be linked in the transversal direction at the plane electrode sections located opposite to the respective plane discharging gaps by same members and the trace electrodes may be arranged above or below the transversally extended plane electrode sections.

Embodiment 7

Figure 22A:
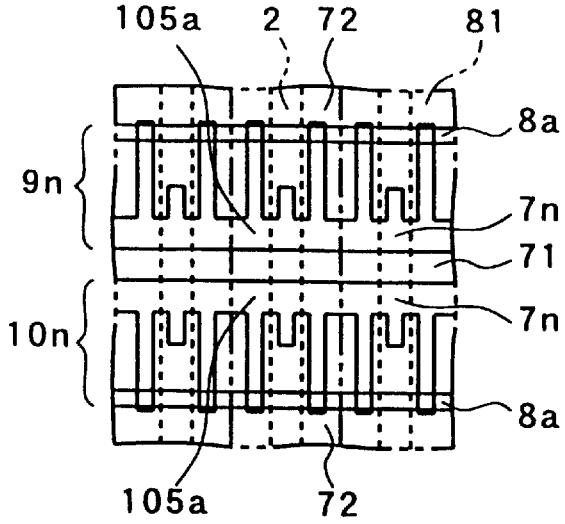
FIGS. 22A through 22C are plan views of plane electrodes of a PDP according to a seventh embodiment of the present invention, illustrating the structural arrangements thereof.
Figure 22B:
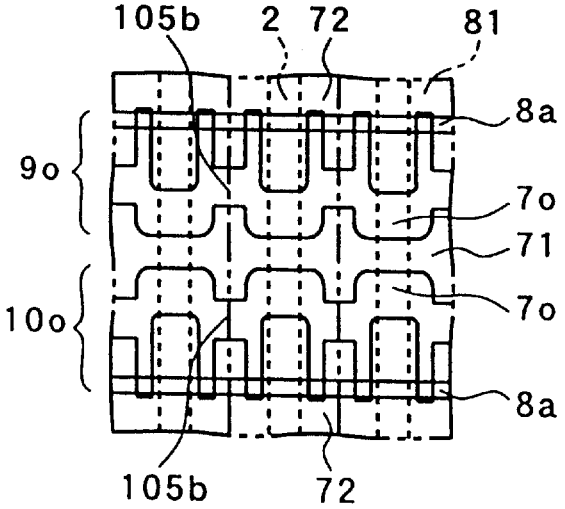
Figure 22C:
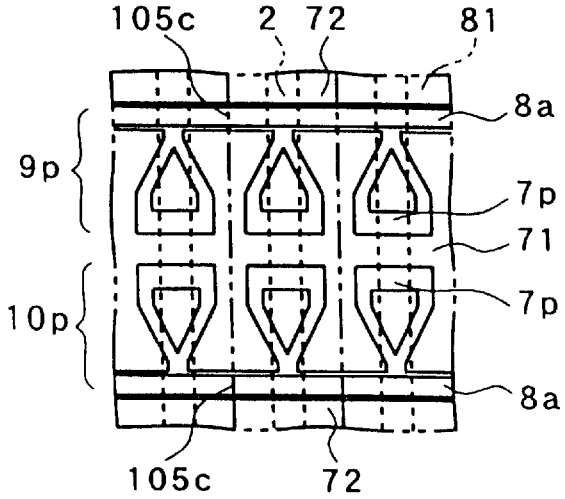

FIGS. 22A through 22C are schematic plan views of three alternatives of a pair of plane electrodes of a PDP according to a seventh embodiment of the present invention, illustrating the structural arrangements thereof. In FIG. 22A, plane electrodes are linked together at the discharging gap side. In FIG. 22B, plane electrodes are linked together at the middle position between the discharging gap side and the non-discharging gap side. In FIG. 22C, plane electrodes are linked together at the non-discharging gap side. To summarize, the plane electrodes of he cells that are arranged adjacently in the column transversal) direction are linked together in this embodiment.

More specifically, FIG. 22A shows plane electrodes 7*n* of cells 81 that are arranged adjacently in the row (transversal) direction are linked together by link members 105*a* at the side of the discharging gaps 71. The plane electrodes 7*n* have a profile same as that of FIG. 19E. FIG. 22B shows plane electrodes 7*o* of cells 81 that are arranged adjacently in the row (transversal) direction are linked together by link members 105*b* at the middle position between the side of the discharging gaps 71 and that of the non-discharging gaps 72. The plane electrodes 7*o* have a profile same as that of the plane electrodes 7*e* of FIG. 9. FIG. 22C shows plane electrodes 7*p* of cells 81 that are arranged adjacently in the row (transversal) direction are linked together by link members 105*c* at the side of the non-discharging gaps 71 or typically on the trace electrodes 8a. The plane electrodes 7*p* have a profile same as that of the plane electrodes 7*m* of FIG. 18.

Thus, with the arrangement of plane electrodes of FIG. 22A, scan electrodes 9*n* and common electrodes 10*n* consists of the plane electrodes 7*n*, the trace electrodes 8*a* and the link members 105*a*. With the arrangement of plane electrodes of FIG. 22B, scan electrodes 9*o* and common electrodes 10*o* consists of the plane electrodes 7*o*, the trace electrodes 8*a* and the link members 105*b*. Finally, with the arrangement of plane electrodes of FIG. 22C, scan electrodes 9*p* and common electrodes 10*p* consists of the plane electrodes 7*p*, the trace electrodes 8*a* and the link members 105*c*.

While the link members 105*a* through 105*c* of this embodiment may be made of an electrically conductive material same as that of the plane electrodes 7*n*, 7*o*, 7*p*, they may alternatively be made of some other electrically conductive material.

In the case of the seventh embodiment where the plane electrodes are connected not only by trace electrodes but also by some other members so that the risk of producing broken wires and/or fissures in the wiring of the electrodes and other structural defects is reduced to further improve the manufacturing yield.

What is claimed is:

1. An alternating current plane discharge type plasma display panel comprising:

a front substrate having a plurality of pairs of scan electrodes and common electrodes arranged in a horizontal direction, said scan electrodes and said common electrodes comprising horizontally extending line electrodes and plane electrodes provided for corresponding unit light emitting pixels, said plane electrodes of said scan electrode and said common electrode in each unit light emitting pixel being separated from each other by a discharging gap, and each of said plane electrodes having a first section located close to said discharging gap and a second section located remotely from said discharging gap;

a back substrate disposed to face said plane electrodes and having a plurality of vertically extending data electrodes, said first section having a part overlapping said data electrode as viewed from above and parts extending horizontally from a part overlapping said data electrode, and said second section having lateral parts extending vertically along lateral edges of said corresponding data electrode as viewed from above; and partition walls arranged between said front substrate and said back substrate to form discharge spaces, said partition walls defining unit light emitting pixels of red, green and blue, discharge gas being introduced in said discharge spaces to generate ultraviolet rays, wherein edges of said first section are curved or intersect each other with an obtuse angle at corners thereof.

2. The alternating current plane discharge type plasma display panel according to claim 1, wherein edges of said second section are curved or intersect each other with an obtuse angle at corners thereof.

3. The alternating current plane discharge type plasma display panel according claim 1, wherein the end part of said second section located opposite to said discharging gap is connected to said line electrode.

4. The alternating current plane discharge type plasma display panel according to claim 1, wherein said second section comprises a part projecting or extending vertically above said data electrode from said first section.

5. The alternating current plane discharge type plasma display panel according to claim 1, wherein said second section comprises parts extending in opposite directions from said lateral parts.

6. The alternating current plane discharge type plasma display panel according to claim 1, wherein said partition walls are formed to extend in the vertical direction at positions located between said data electrodes.

7. The alternating current plane discharge type plasma display panel according to claim 1, wherein said partition walls comprises vertical sections extending in the vertical direction at positions located between said data electrodes and horizontal sections extending in the horizontal direction, said partitions forming a lattice with said vertical sections and said horizontal sections, and each of spaces defined by said vertical sections and said horizontal sections is used for said unit light emitting pixel.

8. The alternating current plane discharge type plasma display panel according to claim 1, wherein said line electrodes and said plane electrodes are made of a metal material.

9. The alternating current plane discharge type plasma display panel according to claim 1, wherein said line electrodes are made of a metal material and said plane electrodes are made of a transparent material.

10. The alternating current plane discharge type plasma display panel according to claim 1, wherein both or either of the profile or the area of said first section and that of said second section are differentiated between the scan electrode and the common electrode.

11. The alternating current plane discharge type plasma display panel according to claim 1, wherein both or either of the profile or the area of said first section and that of said second section are differentiated between the scan electrode and the common electrode in the unit light emitting pixels of red, those of green or those of blue, or in one or more unit light emitting pixels.

12. The alternating current plane discharge type plasma display panel according to claim 1, wherein each of said plane electrodes is made to overlap said data electrode at least at two positions along edges of said plane electrode that are outer edges of a pattern thereof.

13. The alternating current plane discharge type plasma display panel according to claim 1, further comprising an electrically conductive material connecting at least either said scan electrodes or said common electrodes between the horizontally adjacent unit light emitting pixels.

14. An alternating current plane discharge type plasma display panel comprising:

a front substrate having a plurality of pairs of scan electrodes and common electrodes arranged in a horizontal direction, said scan electrodes and said common electrodes comprising horizontally extending line electrodes and plane electrodes provided for corresponding unit light emitting pixels, said plane electrodes of said scan electrode and said common electrode in each unit light emitting pixel being separated from each other by a discharging gap, and each of said plane electrodes having a first section located close to said discharging gap and a second section located remotely from said discharging gap;

a back substrate disposed to face said plane electrodes and having a plurality of vertically extending data electrodes, said first section having a part overlapping said data electrode as viewed from above and parts extending horizontally from a part overlapping said data electrode, and said second section having lateral parts extending vertically along lateral edges of said corresponding data electrode as viewed from above; and partition walls arranged between said front substrate and said back substrate to form discharge spaces, said partition walls defining unit light emitting pixels of red, green and blue, discharge gas being introduced in said discharge spaces to generate ultraviolet rays, wherein said second section comprises parts extending in opposite directions from said lateral parts, wherein said extending parts are connected to each other.

15. The alternating current plane discharge type plasma display panel according to claim 14, wherein said plane electrodes are π-shaped.

16. An alternating current plane discharge type plasma display panel comprising:

a front substrate having a plurality of pairs of scan electrodes and common electrodes arranged in a horizontal direction, said scan electrodes and said common electrodes comprising horizontally extending line electrodes and plane electrodes provided for corresponding unit light emitting pixels, said plane electrodes of the said scan electrode and said common electrode in each unit light emitting pixel being separated from each other by a discharging gap, and each of said plane electrodes having a first section located close to said discharging gap and a second section located remotely from said discharging gap;

a back substrate disposed to face said plane electrodes and having a plurality of vertically extending data electrodes, said first section having a part overlapping said data electrode as viewed from above and parts extending horizontally from a part overlapping said data electrode, and said second section having lateral parts extending vertically along lateral edges of said corresponding data electrode as viewed from above; and partition walls arranged between said front substrate and said back substrate to form discharge spaces, said partition walls defining unit light emitting pixels of red, green and blue, discharge gas being introduced in said discharge spaces to generate ultraviolet rays, wherein said second section comprises an inclined part extending in a direction inclined relative to the vertical direction and connecting said lateral parts and a horizontal central part of said first section.

17. An alternating current plane discharge type plasma display panel comprising:

a front substrate having a plurality of pairs of scan electrodes and common electrodes arranged in a horizontal direction, said scan electrodes and said common electrodes comprising horizontally extending line electrodes and plane electrodes provided for corresponding unit light emitting pixels, said plane electrodes of the said scan electrode and said common electrode in each unit light emitting pixel being separated from each other by a discharging gap, and each of said plane electrodes having a first section located close to said discharging gap and a second section located remotely from said discharging gap;

a back substrate disposed to face said plane electrodes and having a plurality of vertically extending data electrodes, said first section having a part overlapping said data electrode as viewed from above and parts extending horizontally from a part overlapping said data electrode, and said second section having lateral parts extending vertically along lateral edges of said corresponding data electrode as viewed from above; and partition walls arranged between said front substrate and said back substrate to form discharge spaces, said partition walls defining unit light emitting pixels of red, green and blue, discharge gas being introduced in said discharge spaces to generate ultraviolet rays, wherein said second section comprises an inclined part extending in a direction inclined relative to the vertical direction and connecting said lateral parts and horizontally opposite ends of said first section.

18. An alternating current plane discharge type plasma display panel comprising:

a front substrate having a plurality of pairs of scan electrodes and common electrodes arranged in a horizontal direction, said scan electrodes and said common electrodes comprising horizontally extending line electrodes and plane electrodes provided for corresponding unit light emitting pixels, said plane electrodes of the said scan electrode and said common electrode in each unit light emitting pixel being separated from each other by a discharging gap, and each of said plane electrodes having a first section located close to said discharging gap and a second section located remotely from said discharging gap;

a back substrate disposed to face said plane electrodes and having a plurality of vertically extending data electrodes, said first section having a part overlapping said data electrode as viewed from above and parts extending horizontally from a part overlapping said data electrode, and said second section having lateral parts extending vertically along lateral edges of said corresponding data electrode as viewed from above; and partition walls arranged between said front substrate and said back substrate to form discharge spaces, said partition walls defining unit light emitting pixels of red, green and blue, discharge gas being introduced in said discharge spaces to generate ultraviolet rays, wherein said second section comprises a part connecting ends thereof located remotely from said discharging gap.

19. An alternating current plane discharge type plasma display panel comprising:

a front substrate having a plurality of pairs of scan electrodes and common electrodes arranged in a horizontal direction, said scan electrodes and said common electrodes comprising horizontally extending line electrodes and plane electrodes provided for corresponding unit light emitting pixels, said plane electrodes of the said scan electrode and said common electrode in each unit light emitting pixel being separated from each other by a discharging gap, and each of said plane electrodes having a first section located close to said discharging gap and a second section located remotely from said discharging gap;

a back substrate disposed to face said plane electrodes and having a plurality of vertically extending data electrodes, said first section having a part overlapping said data electrode as viewed from above and parts extending horizontally from a part overlapping said data electrode, and said second section having lateral parts extending vertically along lateral edges of said corresponding data electrode as viewed from above; and partition walls arranged between said front substrate and said back substrate to form discharge spaces, said partition walls defining unit light emitting pixels of red, green and blue, discharge gas being introduced in said discharge spaces to generate ultraviolet rays, wherein a distance between plane electrodes forming said discharging gap is made to vary continuously or discontinuously in the transversal direction of said plane electrodes.

20. An alternating current plane discharge type plasma display panel comprising:

a front substrate having a plurality of pairs of scan electrodes and common electrodes arranged in a horizontal direction, said scan electrodes and said common electrodes comprising horizontally extending line electrodes and plane electrodes provided for corresponding unit light emitting pixels, said plane electrodes of the said scan electrode and said common electrode in each unit light emitting pixel being separated from each other by a discharging gap, and each of said plane electrodes having a first section located close to said discharging gap and a second section located remotely from said discharging gap;

a back substrate disposed to face said plane electrodes and having a plurality of vertically extending data electrodes, said first section having a part overlapping said data electrode as viewed from above and parts extending horizontally from a part overlapping said data electrode, and said second section having lateral parts extending vertically along lateral edges of said corresponding data electrode as viewed from above; and partition walls arranged between said front substrate and said back substrate to form discharge spaces, said partition walls defining unit light emitting pixels of red, green and blue, discharge gas being introduced in said discharge spaces to generate ultraviolet rays, wherein said second section comprises an inclined part extending in a direction inclined relative to the vertical direction from said lateral parts to said line electrode so as to come closer.

21. The alternating current plane discharge type plasma display panel according to claim 20 wherein said inclined part is tapered toward said line electrode.

22. The alternating current plane discharge type plasma display panel according to claim 20, wherein said inclined part is connected to said line electrode at a position overlapping corresponding edges of said date electrode as viewed from above.

23. The alternating current plane discharge type plasma display panel according to claim 20, wherein said inclined part is connected to said line electrode at a position located at the transversal center of said data electrode.

* * * * *

UNITED STATES PATENT AND TRADEMARK OFFICE

CERTIFICATE OF CORRECTION

PATENT NO. : 6,512,337 B2 
DATED : January 28, 2003
INVENTOR(S) : Naoto Hirano, Hiroshi Hasegawa and Nobumitsu Aibara It is certified that error appears in the above-identified patent and that said Letters Patent is hereby corrected as shown below:

Column 2,
Line 11, change "SnO2" to -- $SnO_2$ --;
Line 29, change "SiO2 or B2O3" to -- $SiO_2$ or $B_2O_3$ --.

Column 7,
Line 67, change "comers" to -- corners --.

Column 16,
Line 67, change "DP" to -- PDP --.

Signed and Sealed this

Sixth Day of May, 2003

JAMES E. ROGAN
*Director of the United States Patent and Trademark Office*